US008873998B2

(12) United States Patent
Kitamura

(10) Patent No.: US 8,873,998 B2
(45) Date of Patent: Oct. 28, 2014

(54) IMAGE FORMATION APPARATUS

(71) Applicant: Oki Data Corporation, Tokyo (JP)

(72) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/037,447

(22) Filed: Sep. 26, 2013

(65) Prior Publication Data

US 2014/0093274 A1 Apr. 3, 2014

(30) Foreign Application Priority Data

Sep. 28, 2012 (JP) ..... 2012-217503

(51) Int. Cl.
*G03G 21/18* (2006.01)
*G03G 15/01* (2006.01)
*G03G 21/16* (2006.01)

(52) U.S. Cl.
CPC .... *G03G 21/1671* (2013.01); *G03G 2215/0193* (2013.01); *G03G 15/0136* (2013.01); *G03G 2215/0141* (2013.01)
USPC ..... 399/111; 399/167

(58) Field of Classification Search
CPC ..... G03G 21/1671; G03G 21/1853; G03G 15/757
USPC ..... 396/111, 112, 167
See application file for complete search history.

(56) References Cited

U.S. PATENT DOCUMENTS

| | | | | |
|---|---|---|---|---|
| 8,358,944 | B2 * | 1/2013 | Yamade | 399/39 |
| 8,611,786 | B2 * | 12/2013 | Mizuno et al. | 399/111 |
| 2003/0053819 | A1 * | 3/2003 | Nomura et al. | 399/110 |
| 2010/0111562 | A1 * | 5/2010 | Okabe et al. | 399/112 |
| 2012/0321344 | A1 * | 12/2012 | Noguchi | 399/112 |
| 2014/0093274 | A1 * | 4/2014 | Kitamura | 399/111 |
| 2014/0093279 | A1 * | 4/2014 | Hayakawa et al. | 399/117 |

FOREIGN PATENT DOCUMENTS

| | | | |
|---|---|---|---|
| JP | 2003-215880 | A | 7/2003 |
| JP | 2006-078544 | A | 3/2006 |

* cited by examiner

*Primary Examiner* — W B Perkey
(74) *Attorney, Agent, or Firm* — Marvin A. Motsenbocker; Mots Law, PLLC

(57) ABSTRACT

An image formation apparatus includes: an image formation unit including an image carrier configured to carry a developer image; a drive unit configured to drive the image carrier; a holder provided with the drive unit; a transfer unit located to be opposed to the image carrier and configured to transfer the developer image from the image carrier on a transfer medium; and a switching unit configured to switch a position of the holder between an image formation position, at which the transfer unit transfers the developer image from the image carrier on the transfer medium, and a non-image formation position. The holder is configured to move together with the image formation unit.

19 Claims, 38 Drawing Sheets

IMAGE FORMATION APPARATUS

CROSS REFERENCE TO RELATED APPLICATIONS

This application claims priority based on 35 USC 119 from prior Japanese Patent Application No. 2012-217503 filed on Sep. 28, 2012, entitled "IMAGE FORMATION APPARATUS", the entire contents of which are incorporated herein by reference.

BACKGROUND OF THE INVENTION

1. Field of the Invention

The disclosure relates to an image formation apparatus using an electrophotographic system.

2. Description of Related Art

An image formation apparatus provided with multiple image formation units is known in which an image formation unit not in use is moved by an up-down mechanism from an image formation position to a non-image formation position. Examples of an image formation apparatus provided with such an up-down mechanism include an image formation apparatus disclosed in Japanese Patent Application Publication No. 2006-78544 and a color image recording apparatus disclosed in Japanese Patent Application Publication No. 2003-215880.

In such an up-down mechanism, when the image formation unit is moved from the image formation position to the non-image formation position, a connection of gears is released, and when being moved from the non-image formation position to the image formation position, the gears are connected.

SUMMARY OF THE INVENTION

However, in the conventional image formation apparatus, the printing quality might be lowered in some cases.

An aspect of the invention is an image formation apparatus that includes: an image formation unit including an image carrier configured to carry a developer image; a drive unit configured to drive the image carrier; a holder provided with the drive unit; a transfer unit located to be opposed to the image carrier and configured to transfer the developer image from the image carrier on a transfer medium; and a switching unit configured to switch a position of the holder, between an image formation position at which the transfer unit transfers the developer image from the image carrier on the transfer medium and a non-image formation position. The holder is configured to move together with the image formation unit.

According to the above aspect, a high printing quality can be maintained.

DETAILED DESCRIPTION OF EMBODIMENTS

Figure 1:
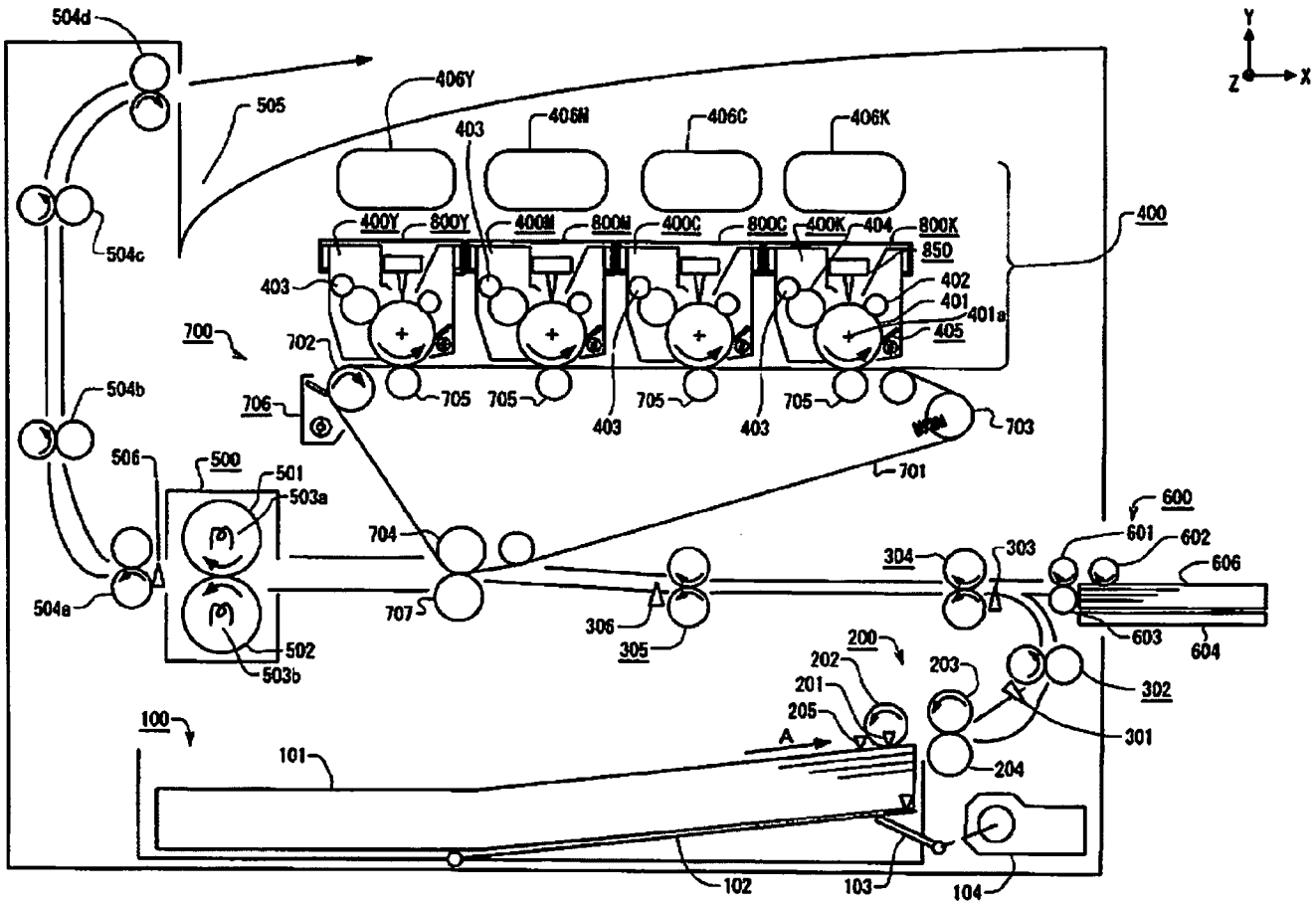
FIG. 1 is a schematic configuration view illustrating an image formation apparatus according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Image formation apparatuses according to embodiments of the invention are described below.

First Embodiment

Firstly, an image formation apparatus according to a first embodiment of the invention is described. Hereinafter, an outline of the image formation apparatus according to the embodiment is described on the basis of FIG. 1, and then detail configurations of units thereof are described. FIG. 1 is a schematic configuration view illustrating the image formation apparatus according to the first embodiment of the invention.

In the drawing, the image formation apparatus includes paper tray 100 provided on a bottom part thereof. Paper tray 100 is detachably mounted to the image formation apparatus. Printing paper sheets 101 as recording media are stacked and housed inside paper tray 100. In addition, paper placement plate 102 pivotally supported by an existing support shaft (not illustrated) is provided inside paper tray 100. Printing paper sheets 101 are placed on paper placement plate 102. At a feeding side of paper tray 100, lift-up lever 103 is disposed to be rotatable about an existing support shaft (not illustrated). The support shaft of lift-up lever 103 is engaged with motor 104 in a connectable and disconnectable manner to be connected to and separated from each other as appropriate. Accordingly, when the paper tray 100 is inserted into the image formation apparatus, lift-up lever 103 and motor 109 engage with each other, and an existing controller (not illustrated) provided in the apparatus drives motor 104. Accordingly, motor 104 rotates lift-up lever 103, so that a tip part of lift-up lever 103 lifts a bottom part of paper placement plate 102 upward to move printing paper sheets 101 placed on paper placement plate 102 upward. Further, when printing paper sheets 101 move upward to a predetermined height to abut on pickup roller 202, upward movement detector 201 detects the abutting. The controller stops motor 104 on the basis of information detected by upward movement detector 201. Accordingly, pickup roller 202 is in contact with printing paper sheets 101 all the time. Pickup roller 202 constitutes paper feeder 200 together with feed roller 203 and retard roller 204 which are disposed as a pair. Pickup roller 202 and feed roller 203 are driven to be rotated in the arrow directions by an existing motor (not illustrated). Existing one-way clutch mechanisms (not illustrated) are incorporated into pickup roller 202 and feed roller 203. The one-way clutch mechanisms allow pickup roller 202 and feed roller 203 to rotate idly in the arrow directions even when the driving rotation by the motor is stopped. Moreover, retard roller 204 generates a torque by an existing torque generation section (not illustrated) in a direction to suppress the feed of multiple printing paper sheets 101 from being overlapped on one another.

Accordingly, pickup roller 202 draws out printing paper sheet 101 from the inside of paper tray 100. Feed roller 203 and retard roller 204 feed printing paper sheet 101 drawn out by pickup roller 202 to a conveyance path. In this case, when pickup roller 202 simultaneously draws out multiple printing paper sheets 101, feed roller 203 and retard roller 204 successively feed multiple printing paper sheets 101 one by one to the conveyance path.

At a downstream side of paper feeder 200 in a conveyance direction of printing paper sheets 101, various kinds of rollers and the like are disposed. Specifically, disposed sequentially from paper feeder 200 toward the downstream side are: paper sensor 301, a pair of conveyance rollers 302 which prevent a skew of printing paper sheet 101, paper sensor 303 which detects a next driving timing of pair of conveyance rollers 304, pairs of conveyance rollers 304 and 305 which send printing paper sheet 101 into image formation section 400, and write sensor 306 for determining a write timing in image formation section 400. Power is transmitted to pairs of conveyance rollers 302, 304, and 305 from an existing conveyance drive motor (not illustrated) through an existing drive transmission section (not illustrated).

Multi-purpose tray (MPT) 600 is provided on the right side face of the image formation apparatus in FIG. 1. MPT 600 supplies paper sheets 606 that are placed on paper placement plate 604. MPT 600 is configured to include the following: paper placement plate 604 on which paper sheets 606 are placed, pick roller 602 which comes into contact with each paper sheet 606 to feed it, paper supply roller 601 which sends out the fed paper sheet to an apparatus main body and retard roller 603 for separating the fed paper sheets one by one. Retard roller 603 is biased toward and abut on paper supply roller 601.

Image formation section 400 is a device for forming images from the colors of yellow, magenta, cyan, and black. Image formation section 400 is configured to include four image formation units 400K, 400Y, 400M, and 400C, and toner storage units 406K, 406Y, 406M, and 406C for supplying toner as developers to the respective image formation units. These units are mounted to the upper portion of intermediate transfer belt unit 700.

Image formation units 400K, 400Y, 400M, and 400C have a common configuration. Therefore, hereinafter, the configuration of image formation unit 400K for the black color is explained, and explanations of other image formation units 400Y, 400M, and 400C are omitted.

Image formation unit 400K includes photoconductive drum 401 as an image carrier disposed to be rotatable in the arrow direction (FIG. 1). Photoconductive drum 401 is rotatably supported by rotation shaft 401*a*. Charge roller 402, exposure device 850, supply roller 403, development roller 404, and drum cleaner 405 are disposed around photoconductive drum 401.

Charge roller 402 is a roller for electrifying the surface of photoconductive drum 401 which is thereby charged. Exposure device 850 is a device for selectively emitting light on the charged surface of photoconductive drum 401 to form an electrostatic latent image thereon. Development roller 404 is a roller for adhering toner as a black developer on the surface of photoconductive drum 401 on which the electrostatic latent image is formed, thereby forming a toner image as a developer image. Drum cleaner 405 is a device for removing transfer residual toner remaining on photoconductive drum 401 when the toner image is transferred.

Toner storage unit 406K is a member for storing toner therein. Toner storage unit 406K supplies toner to development roller 404 by means of an existing supply section (not illustrated).

Intermediate transfer belt unit 700 as a transfer unit is a unit for transferring the toner image of the image formation section 400 on printing paper sheet 101. Intermediate transfer belt unit 700 is disposed along the conveyance path for printing paper sheet 101 and opposite to image formation units 400K, 400Y, 400M, and 400C of image formation section 400. Accordingly, intermediate transfer belt unit 700 is configured to transfer the toner image formed by image formation section 400 temporarily on intermediate transfer belt 701 as an transfer medium. Intermediate transfer belt unit 700 then transfers the toner image on printing paper sheet 101 supplied from paper tray 100 or MPT 600. Intermediate transfer belt unit 700 is configured to include drive roller 702 supported by belt frame 708, tension roller 703, secondary transfer backup roller 704, intermediate transfer belt 701 as a transfer medium, belt cleaner 706, primary transfer rollers 705, and the like.

Drive roller 702 is a roller for driving intermediate transfer belt 701 to be rotated. Drive roller 702 is driven by an existing motor (not illustrated). Tension roller 703 is a roller for applying a tension to intermediate transfer belt 701. Tension roller 703 is supported by a bias section such as a coil spring, and applies a constant tension to intermediate transfer belt 701. Secondary transfer backup roller 704 is a roller for transferring the toner image onto printing paper sheet 101. Secondary transfer backup roller 704 is disposed to be opposed to secondary transfer roller 707, and transfers the toner image passing between these rollers onto printing paper sheets 101. Secondary transfer roller 707 and secondary transfer backup roller 704 constitute a transfer unit. Intermediate transfer belt 701 is a belt for temporarily receiving the toner image from the image formation section 400, and transferring the toner image thus received onto printing paper sheet 101. Intermediate transfer belt 701 is extended among the respective rollers, and is rotated by drive roller 702. Belt cleaner 706 is a device for removing toner remaining on intermediate transfer belt 701. Belt cleaner 706 scraps off the toner remaining after the toner image is transferred onto printing paper sheet 101 off and thereby removes the toner. Primary transfer rollers 705 are rollers for transferring the toner image formed on photoconductive drum 401 on intermediate transfer belt 701 by applying a predetermined voltage thereto. Primary transfer rollers 705 are disposed opposite to respective photoconductive drums 401.

Hereinafter, using FIG. 9, FIG. 10, and FIG. 11, intermediate transfer belt unit 700 is described. As illustrated in FIG. 11, each of the left and right side plates 711*a*, 711*b* of belt frame 708 includes four protrusion reception parts 708*a* provided on the upper side face thereof. Respective protrusion reception parts 708*a*F, 708*a*R are members for accurately positioning and supporting respective image formation units 400K, 400Y, 400M, and 400C of image formation section 400. Protrusion reception parts 708*a* are formed of a V-groove. Semicircular pillar protrusion parts 409F, 409R, which are described later, are fitted into the V-grooves of protrusion reception parts 708*a*, so that respective image formation units 400K, 400Y, 400M, and 400C are accurately positioned and supported.

Intermediate transfer belt unit 700 of the above configuration is detachably mounted relative to the apparatus main body. Although intermediate transfer belt unit 700 is detachably mounted to the apparatus main body, once when being mounted, intermediate transfer belt unit 700 is positioned and fixed relative to the apparatus main body.

Referring back to FIG. 1, four image formation units 400K, 400Y, 400M, and 400C of image formation section 400 are accurately positioned and supported relative to intermediate transfer belt unit 700 in a state of being opposed to intermediate transfer belt 701 of intermediate transfer belt unit 700, which is specifically described later.

Fixation unit 500 is a device for fixing the toner image transferred onto printing paper sheet 101. Fixation unit 500 is configured to include a pair of rollers, upper roller 501 and lower roller 502. Upper roller 501 includes a surface made of an elastic body. Upper roller 501 is provided with halogen lamp 503*a* as a thermal source therein. Lower roller 502 includes a surface made of an elastic body. Lower roller 502 is provided with halogen lamp 503*b* as a thermal source therein. The pair of these rollers of upper roller 501 and lower roller 502 fixes the toner image on printing paper sheets 101 sent out from image formation section 400. In other words, upper roller 501 and lower roller 502 sandwich printing paper sheet 101 therebetween to apply a pressure to the toner image on printing paper sheets 101, and halogen lamp 503*a* and halogen lamp 503*b* apply heat to the toner image on printing paper sheets 101. This fuses the toner image to fix the image to printing paper sheet 101.

Thereafter, pairs of conveyance rollers 504*a*, 504*b*, 504*c*, and 504*d* convey printing paper sheet 101. Further, printing paper sheet 101 is discharged to stacker unit 505. Power is transmitted to these pairs of conveyance rollers from an existing drive source (not illustrated) through an existing drive transmission section (not illustrated). Paper sensor 506, disposed in an output unit of fixation unit 500, detects each driving timing of the pairs of conveyance rollers 504*a*, 504*b*, 504*c*, and 504*d*.

Figure 2:
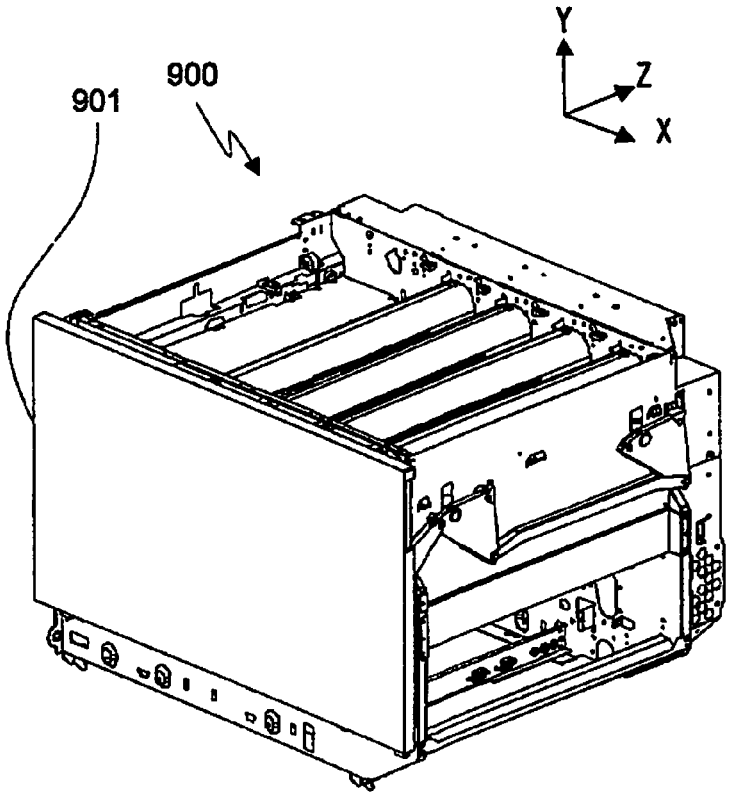
FIG. 2 is a perspective view illustrating an apparatus main body of the image formation apparatus in the embodiment.
Figure 3:
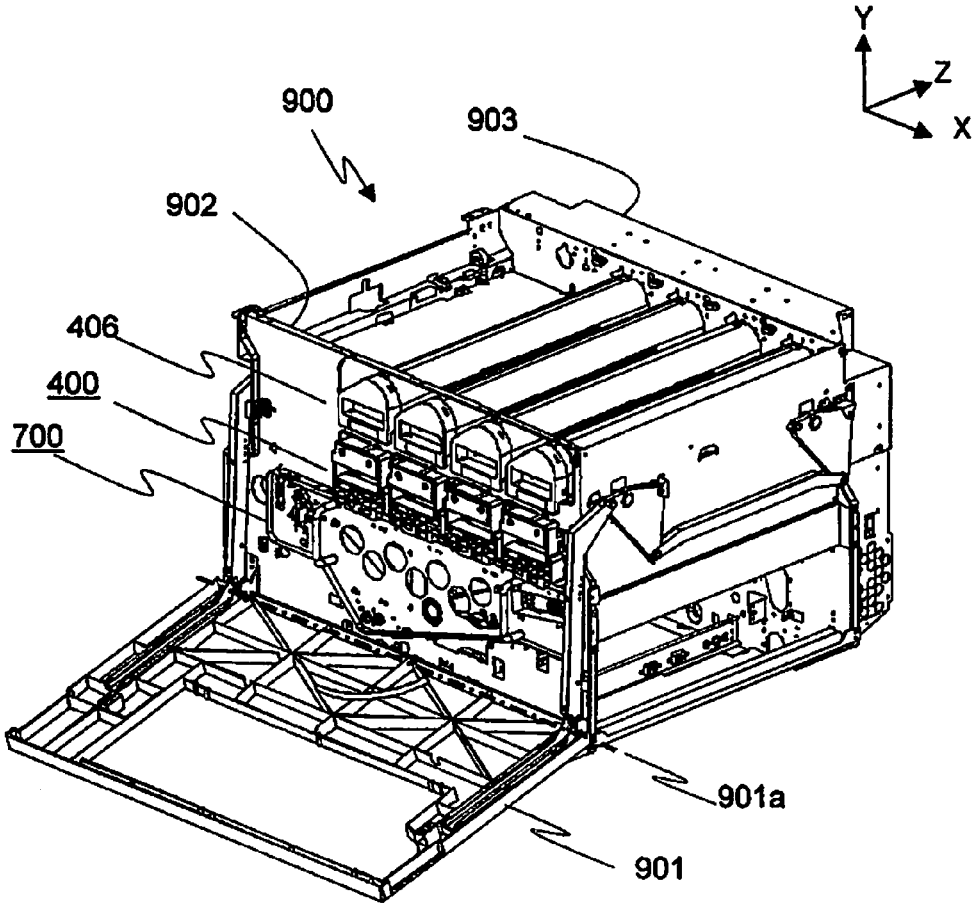
FIG. 3 is a perspective view illustrating the apparatus main body of the image formation apparatus in the embodiment in a state where a front cover thereof is opened.
Figure 4:
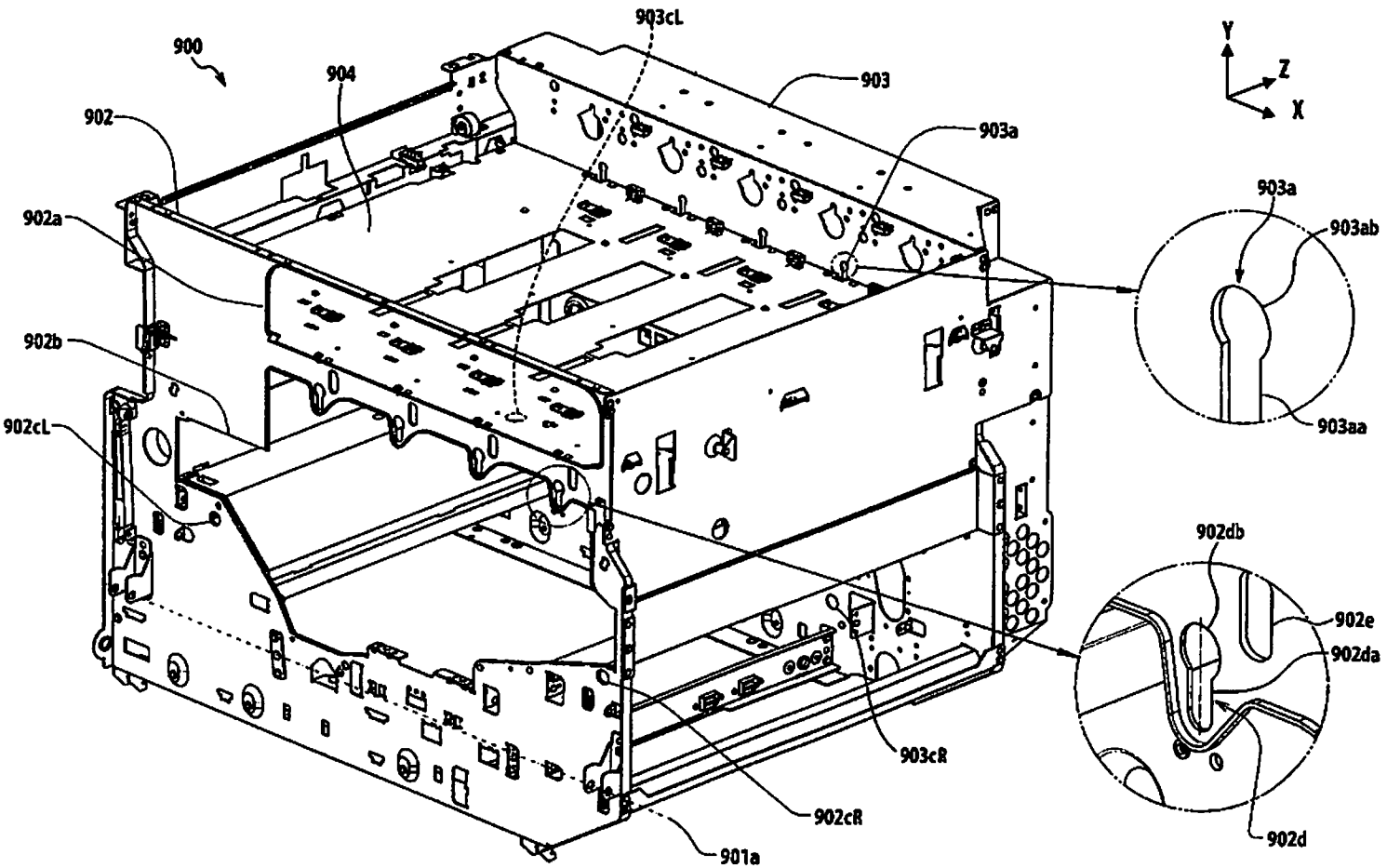
FIG. 4 is a perspective view illustrating a frame structure of the main body of the image formation apparatus in the embodiment.

Next, the specific configuration of the image formation apparatus according to the embodiment is described. FIG. 2 is a perspective view illustrating an apparatus main body of the image formation apparatus in the embodiment, FIG. 3 is a perspective view illustrating the apparatus main body of the image formation apparatus in the embodiment in a state where front cover 901 thereof is opened. FIG. 4 is a perspective view illustrating a frame structure of the main body of the image formation apparatus in the embodiment.

As illustrated in FIG. 3, front cover 901 is pivotally supported by main body frame 900 about support point 901*a* as an axis. Respectively stored in main body frame 900 are: image formation section 400, intermediate transfer belt unit 700 for carrying a toner image formed by image formation section 400 and transferring the toner image on a conveyed medium, and toner storage unit 406 for supplying toner to image formation section 400. Intermediate transfer belt unit 700, image formation units 400K, 400Y, 400M, and 400C, and toner storage unit 406 are configured to be attached or detached in the Z direction with front cover 901 being opened. This Z direction is the same direction as the opening and closing direction of front cover 901.

As illustrated in FIG. 4, opening unit 902*a* for storing toner storage unit 406, and opening unit 902*b* for storing image formation section 400 and intermediate transfer belt unit 700, are formed on front plate 902 of main body frame 900. Support plate 904 supports respective toner storage units 406 in a horizontal state when respective toner storage units 406 are inserted, and is provided in main body frame 900 facing opening unit 902*a*. In addition, around opening unit 902*b* of front plate 902, engagement holes 902*c*L, 902*c*R are formed at positions corresponding to positioning pins 709L, 709R, which are described later, of intermediate transfer belt unit 700. In addition, engagement holes 903cL, 903cR are formed at positions on rear plate 903 corresponding to positioning pins 710L, 710R, which are described later, of intermediate transfer belt unit 700. Accordingly, positioning pins 709L, 709R and positioning pins 710L, 710R are respectively fitted into engagement holes 902cL, 902cR and engagement holes 903cL, 903cR. In this way, intermediate transfer belt unit 700 is accurately positioned and held relative to main body frame 900.

In addition, long holes 902*d* with which positioning pins 414, which are described later, of image formation section 400 are engaged are formed at the upper portion side around opening unit 902*b* of front plate 902. Four long holes 902*d* are provided at equal intervals above opening unit 902*b*. Respective long holes 902*d* are holes for respectively supporting four image formation units 400K, 400Y, 400M, and 400C of image formation section 400 in a movable manner. Long holes 902*d* are formed to be long in the direction to cause respective image formation units 400K, 400Y, 400M, and 400C to move closer to and away from intermediate transfer belt unit 700. In the embodiment, long holes 902*d* are formed to be long in the vertical direction in such a manner that respective photoconductive drums 401 can vertically move closer to and away from the horizontal upper side face of intermediate transfer belt 701. Long hole 902*d* includes upper end portion 902*db* and groove part 902*da*. Upper end portion 902*db* is formed with a diameter slightly larger than the groove width of groove part 902*da* and the diameter of positioning pin 414 for inserting positioning pin 414 thereto. Groove part 902*da* is formed with a width slightly larger than the diameter of positioning pin 414.

Figure 7:
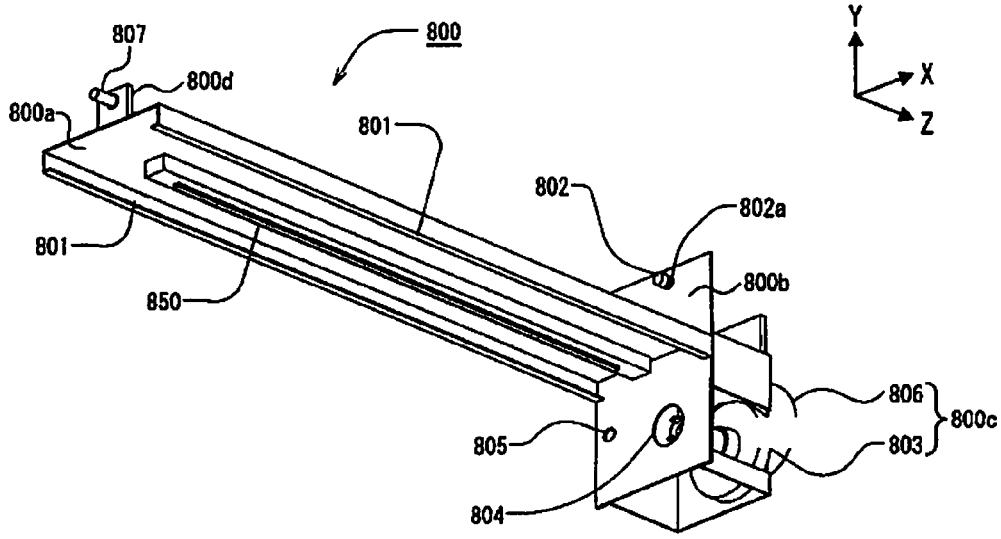
FIG. 7 is a perspective view of a rail unit seen from the lower side.

As illustrated in FIG. 4, long holes 903*a* are provided on rear plate 903 of main body frame 900. Long holes 903*a* are holes with which guide pins 802 of rail units 800 illustrated in FIG. 7 are engaged. Four long holes 903*a* are provided similar to long holes 902*d*. Long holes 903*a* are formed to be long in the direction to cause respective image formation units 400K, 400Y, 400M, and 400C to move closer to and away from intermediate transfer belt unit 700. In the embodiment, long holes 903*a* are formed to be long in the vertical direction similar to long holes 902*d*.

Long hole 903*a* includes upper end portion 903*ab* and groove part 903*aa*. Upper end portion 903*ab* is formed with a diameter slightly larger than the groove width of groove part 903*aa* and the diameter of guide pin 802 for inserting guide pin 802 thereto. Groove part 903*aa* is formed with a width slightly larger than the diameter of fit groove 802*a* of guide pin 802.

Moreover, long holes 902*e*, which engage with pins 807 disposed on rail units 800, are formed on front plate 902. Long hole 902*e* extends in the vertical upper and lower direction. Moreover, a backlash due to the engagement between the width of long hole 902*e* and the diameter of pin 807 is made to be larger than a backlash due to the engagement between the width of groove part 902*da* and the diameter of positioning pin 414 and larger than a backlash due to the engagement between the width of groove part 903*aa* and the diameter of fit groove 802*a*. This allows image formation unit 400K to be moved smoothly in the upper and lower direction during operations thereof of contacting with, and separating from, intermediate transfer belt unit 700.

Moreover, when image formation unit 400K is detached from rail unit 800, rail unit 800 is held to main body frame 900 by the engagement between long hole 902*e* and pin 807 and the engagement between groove part 903*aa* and fit groove 802*a*.

Figure 5:
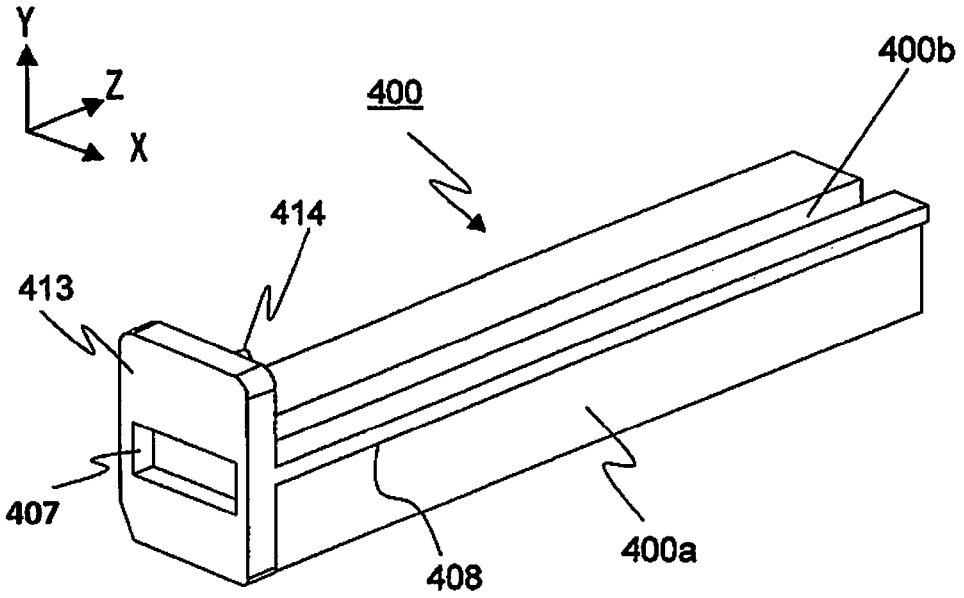
FIG. 5 is a perspective view of an image formation unit seen from the upper side.
Figure 6:
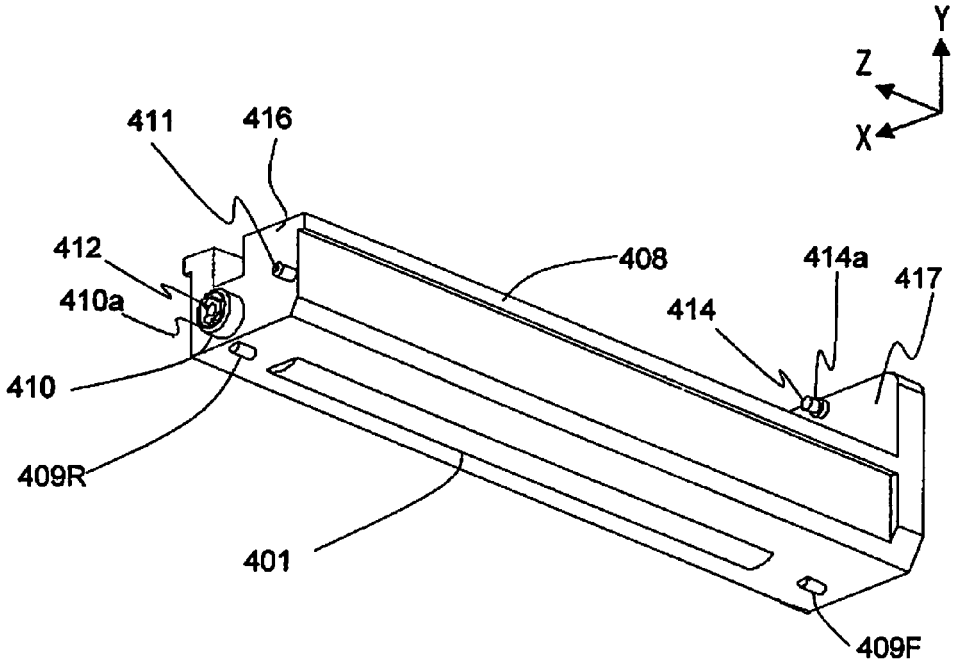
FIG. 6 is a perspective view of the image formation unit seen from the lower side.

FIGS. 5 and 6 are views for explaining the configuration of image formation unit 400K. FIG. 5 is a perspective view of image formation unit 400K seen from the upper side, and FIG. 6 is a perspective view of image formation unit 400K seen from the lower side. Therefore, FIGS. 5 and 6 illustrate each of image formation units 400K, 400Y, 400M, and 400C. Herein, also similar to the above, image formation unit 400K for black color is explained, and explanations of the other similarly configured image formation units 400Y, 400M, and 400C are omitted.

Image formation unit 400K includes support frame part 400*a*, photoconductive drum 401, protrusion parts 409F, 409R, sleeve 410, rotation positioning pin 411, joint 412, and positioning pin 414 as a first support unit. Note that, although development roller 404, drum cleaner 405, or the like are also provided therein, these are omitted for a more simplified explanation.

Support frame part 400*a* is a member for supporting photoconductive drum 401 or the like. Support frame part 400*a* is formed in an approximately quadrangular pillar shape. Fit groove 400*b* is formed on the upper side face of support frame part 400*a* over the entire length in the longitudinal direction. Fit groove 400*b* is a groove into which exposure device 850 is fitted. Photoconductive drum 401 is attached to the lower side face of support frame part 400*a* and is slightly extended therefrom. Rail units 408 for coupling to rail unit 800 are provided on both ends in the shorter direction of the upper side face of support frame part 400*a*. Rail units 408 are formed on both ends of the upper side face of support frame part 400*a*, over the entire length in the longitudinal direction. Rail unit 408 functions as a guide section when image formation unit 400K is mounted to rail unit 800, which is described later. Rail units 408 are fitted into rail support parts 801 of rail unit 800, so that image formation unit 400K and rail unit 800 are coupled with each other.

Handle unit 407 is provided on base end portion 413 formed at one end side in the longitudinal direction of support frame part 400*a*. Handle unit 407 includes an opening into which a hand of an operator can be inserted. The operator takes image formation section 400 in and out by entering the hand into handle unit 407.

Protrusion parts 409F, 409R are protrusions for positioning support frame part 400*a* (image formation section 400). Protrusion parts 409F, 409R are provided in such a manner to protrude through the lower side face of support frame part 400*a*. Protrusion parts 409F, 409R are specifically formed in a semi-circular pillar shape. In addition, protrusion parts 409F, 409R are provided on both sides in the lower side face of support frame part 400*a* so as to sandwich photoconductive drum 401 therebetween. Protrusion parts 409F, 409R are aligned with photoconductive drum 401 so that the center axis of protrusion parts 409F, 409R and the center axis of photoconductive drum 401 are located approximately on the same line. In this manner, protrusion parts 409F, 409R, which are formed in a semi-circular pillar shape and provided in accurate positions relative to photoconductive drum 401, are fitted into protrusion reception parts 708*a*F, 708*a*R of intermediate transfer belt unit 700. In this way, respective photoconductive drums 401 of respective image formation units 400K, 400Y, 400M, and 400C of image formation section 400 can be accurately positioned and supported relative to intermediate transfer belt unit 700.

Sleeve 410 is a member for aligning image formation section 400 with rail unit 800. Sleeve 410 is provided on tip side face 416 at the other end side of base end portion 413 in the longitudinal direction of support frame part 400*a* in such a manner to protrude in the axial direction of photoconductive drum 401. Sleeve 410 is formed in a circular pipe shape. Accordingly, sleeve 410 is fitted into sleeve introduction hole 804, which is described later, of rail unit 800 so to align joint 412, which is described later, with drum drive gear 803, which is also described later, of rail unit 800. Taper 410*a* is an introduction unit to sleeve introduction hole 804 and is provided at the tip side of sleeve 410. This allows sleeve 410 of image formation unit 400K to be easily inserted into sleeve introduction hole 804.

Joint 412 is a joint unit for being connected to drum drive gear 803 of rail unit 800. Joint 412 is provided coaxially with rotation shaft 401*a* of photoconductive drum 401. Joint 412 is fixed to rotation shaft 401*a* and is connected to drum drive gear 803, and thereby transmits the power by motor 806 to photoconductive drum 401 for driving photoconductive drum 401.

Rotation positioning pin 411 is a pin for positioning image formation unit 400K and preventing image formation unit 400K from being rotated. Rotation positioning pin 411 functions so to position image formation unit 400K and prevent image formation unit 400K from being rotated together with sleeve 410. Rotation positioning pin 411 is formed around sleeve 410. Sleeve 410 and rotation positioning pin 411 are formed in such a manner so to protrude from tip side face 416 in the rotation axis direction of photoconductive drum 401, which is the longitudinal direction of image formation unit 400K. Moreover, positioning pin 414 is formed so to protrude from opposite face 417 in the longitudinal direction of image formation unit 400K, which is the rotation axis direction of photoconductive drum 401.

Positioning pin 414 as a second support unit is provided on opposite face 417 of base end portion 413 on which handle unit 407 is formed. Positioning pin 414 is a pin for positioning image formation section 400 relative to main body frame 900. Positioning pin 414 is fitted into long hole 902*d* as a first engagement hole in front plate 902 of main body frame 900, so that image formation section 400 is positioned relative to main body frame 900.

Fit groove 414*a* is provided on a base end of positioning pin 414. Fit groove 414*a* is a groove which is fitted into long holes 902*d*. When positioning pin 414 is inserted into a large circular portion of upper end portion 902*db* of long hole 902*d*, and then shifted downward, fit groove 414*a* is fitted into long hole 902*d* of groove part 902*da*. Accordingly, image formation section 400 is positioned relative to main body frame 900 in an X-axis direction and a Z-axis direction thereof. In addition, a tip side of positioning pin 414 functions as a contact unit which comes into contact with slider 962, which is described later, and is pushed up by slider 962. Accordingly, image formation section 400 is pushed up by slider 962.

Figure 8:
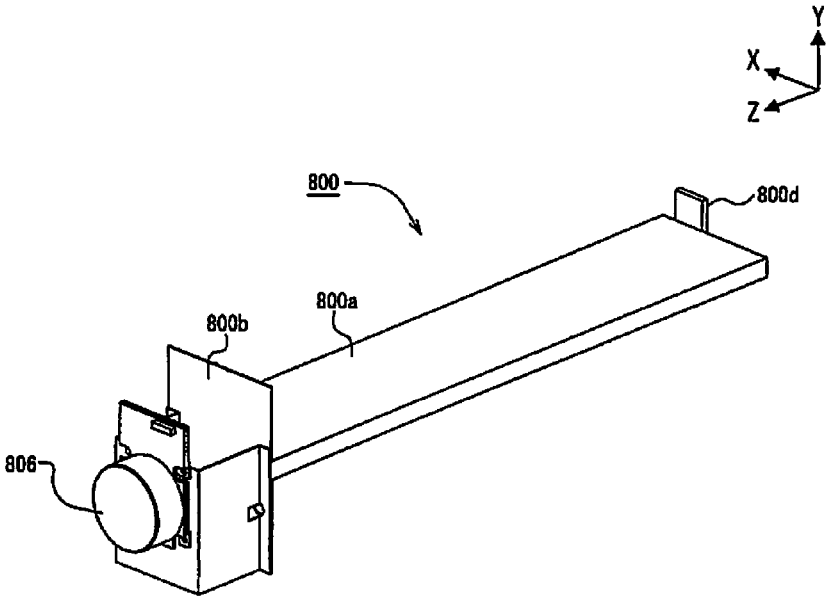
FIG. 8 is a perspective view of the rail unit seen from the upper side.

FIGS. 7 and 8 are explanatory views of rail unit 800 which serves as a holder that removably holds image formation section 400. FIG. 7 is a perspective view of rail unit 800 seen from the lower side, and FIG. 8 is a perspective view of rail unit 800 seen from the upper side.

Rail unit 800 is configured to include flat plate part 800*a*, vertical plate part 800*b*, and drum drive unit 800*c*.

Flat plate part 800*a* is a hold plate which holds image formation section 400 at the lower side thereof. Flat plate part 800*a* is formed in a rectangular shape, and rail support parts 801 are provided on both sides in the shorter direction thereof. Each rail support part 801 is formed such that a cross section thereof is turned back so to have a C-character shape. Accordingly, rail units 408 on both sides of image formation section 400 are fitted into respective rail support parts 801 in the longitudinal direction, so that image formation section 400 is connected to rail unit 800. Exposure device 850 for forming an electrostatic latent image on image formation section 400 is provided on the lower side face of flat plate part 800*a*. Exposure device 850 is fitted into fit groove 400*b* of image formation unit 400K when image formation unit 400K is connected to rail unit 800. Accordingly, exposure device 850 is disposed at a position opposed to photoconductive drum 401.

Vertical plate part 800*b* is a member for supporting rail unit 800. Vertical plate part 800*b* is integrally provided with flat plate part 800*a* at a base end side (right side in FIG. 7) which is one end side in the longitudinal direction of flat plate part 800*a*. Vertical plate part 800*b* is formed approximately vertical relative to Flat plate part 800*a*. Vertical plate part 800*b* is provided with guide pin 802, sleeve introduction hole 804, and long hole 805. Pin 807 and guide pin 802 are formed in such a manner to protrude in the longitudinal direction of rail unit 800, which is the axis direction of photoconductive drum 401.

Pins 807 are formed in such a manner to protrude from other end portion 800*d* formed at the other end side of vertical plate part 800*b* in the longitudinal direction of flat plate part 800*a*. Guide pin 802 is formed in such a manner to protrude from vertical plate part 800*b*.

Guide pin 802 as a second support unit is a pin for positioning rail unit 800 to main body frame 900. In other words, guide pin 802 is a pin for directly positioning rail unit 800 relative to main body frame 900, and indirectly positioning image formation section 400 to main body frame 900. Guide pin 802 is fitted into long hole 903*a* on rear plate 903 of main body frame 900, so that rail unit 800 is positioned relative to main body frame 900.

Fit groove 802*a* is provided at a base end of guide pin 802. Fit groove 802*a* is a groove which is fitted into long hole 903*a*. When guide pin 802 is inserted into a large circular portion of upper end portion 903*ab* of long hole 903*a*, and is then shifted downward, fit groove 802*a* is fitted into groove part 903*aa* of long hole 903*a*. Accordingly, rail unit 800 is positioned relative to main body frame 900 in an X-axis direction and a Z-axis direction thereof. In addition, a tip side of guide pin 802 functions as a contact unit which comes into contact with slider 962, which is described later, and is pushed up by slider 962. Accordingly, rail unit 800 is pushed up by slider 962.

In this manner, rail unit 800 is positioned relative to main body frame 900 and pushed up by slider 962, so that image formation section 400 coupled to rail unit 800 is positioned relative to main body frame 900 and is pushed up in a Y-axis direction by slider 962.

Sleeve introduction hole 804 is a hole into which sleeve 410 of image formation section 400 is fitted. The inner diameter of sleeve introduction hole 804 is set to be larger than the outer diameter of sleeve 410, and to have approximately the same size. This allows sleeve 410 to be fitted into sleeve introduction hole 804 without any backlash. Moreover, a rotation shaft of drum drive gear 803 is disposed in such a manner to be opposed to sleeve introduction hole 804, and is located on an approximate same straight line with a rotation shaft of photoconductive drum 401. Accordingly, sleeve 410 is fitted into sleeve introduction hole 804, so that joint 412 of image formation section 400 is connected to drum drive gear 803 of drum drive unit 800*c*.

Long hole 805 is a hole into which rotation positioning pin 411 of image formation section 400 is fitted. Long hole 805 is formed to be long in the direction of sleeve introduction hole 804, and to be short in the rotation direction centering on sleeve introduction hole 804. The width in the shorter direction of long hole 805 is set to be larger than the outer diameter of rotation positioning pin 411, and to have approximately the same size. This allows rotation positioning pin 411 to be fitted into long hole 805 without any backlash to suppress image formation section 400 from being rotated.

Drum drive unit 800*c* as a drive unit is a device for driving photoconductive drum 401. Drum drive unit 800*c* is integrally provided with vertical plate part 800*b*. Drum drive unit 800*c* includes drum drive gear 803, and motor 806 as a drive motor which is connected to drum drive gear 803 as a drive gear. Drum drive gear 803 is a gear for being connected to joint 412 of image formation unit 400K. Drum drive gear 803 is connected to joint 412, and is connected to photoconductive drum 401 via joint 412. Motor 806 is a motor for rotation-driving photoconductive drum 401. Motor 806 is meshed with drum drive gear 803. Accordingly, motor 806 is connected to photoconductive drum 401 via drum drive gear 803 and joint 412 to rotation-drive photoconductive drum 401.

In the embodiment, motor 806 thus rotationally drives photoconductive drum 401, supply roller 403, charge roller 402, and development roller 404 via a gear or the like, which is not illustrated.

Figure 9:
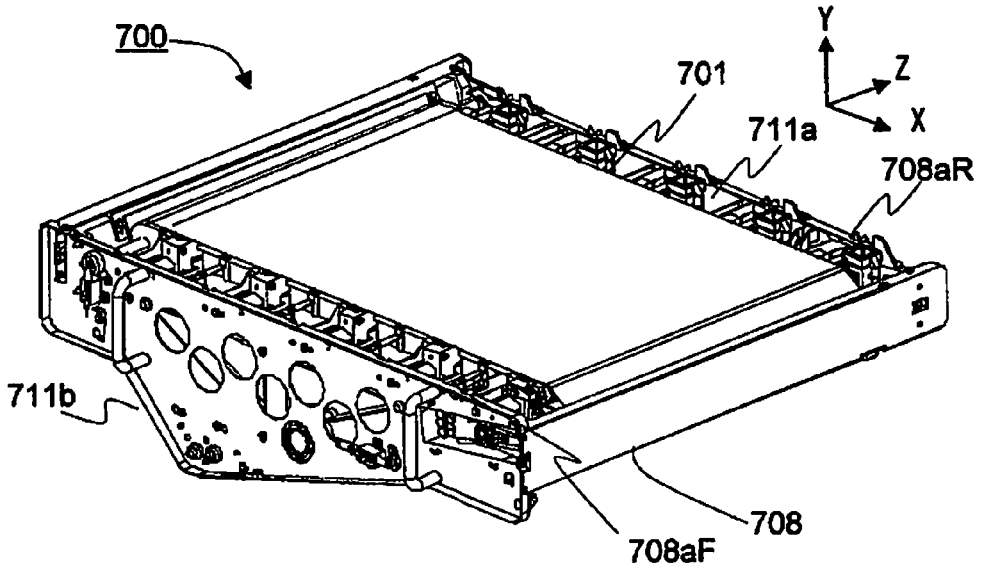
FIG. 9 is a perspective view of an intermediate transfer belt unit seen from the upper side.
Figure 10:
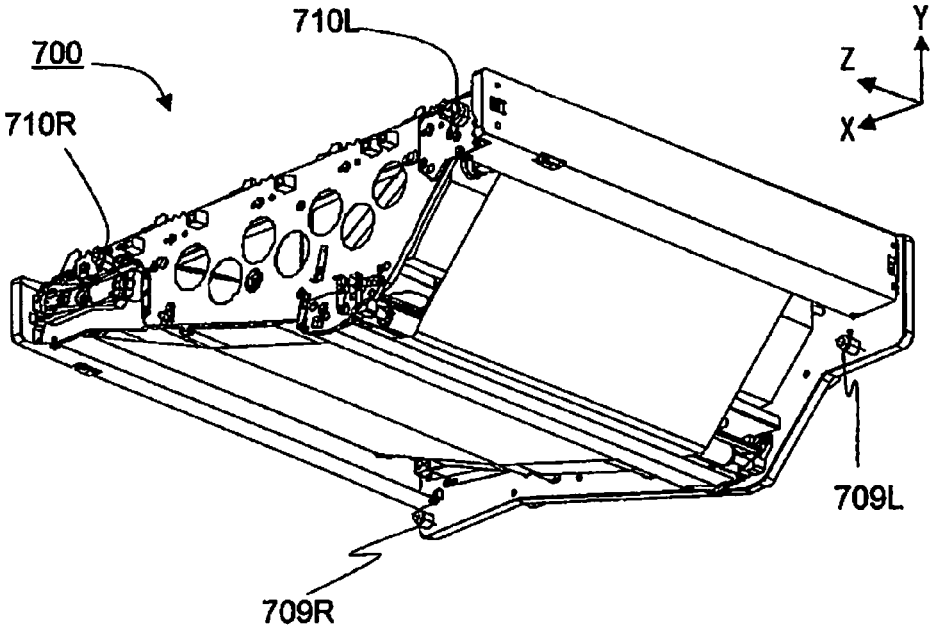
FIG. 10 is a perspective view of the intermediate transfer belt unit seen from the lower side.
Figure 11:
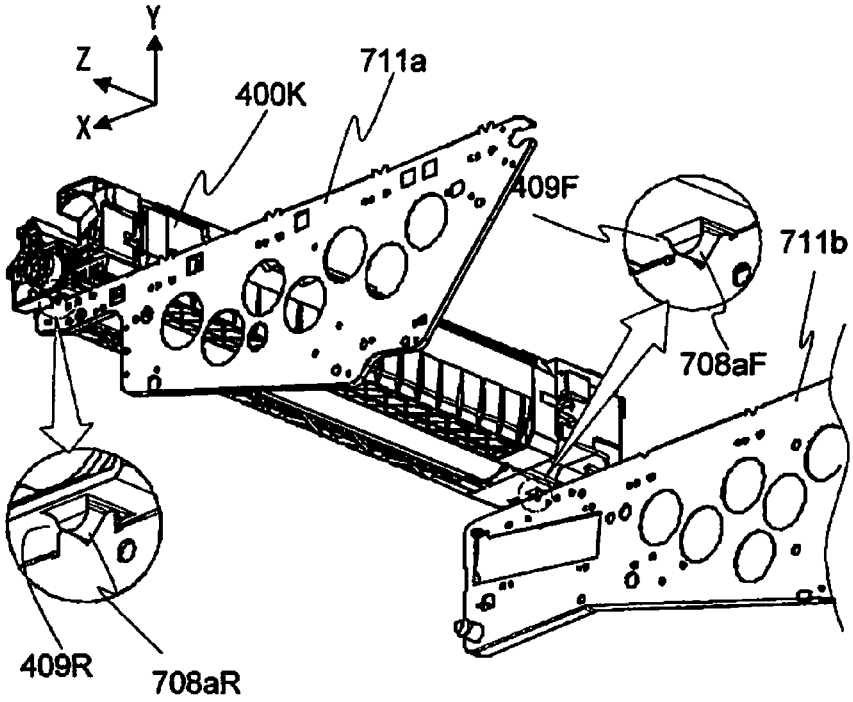
FIG. 11 is an explanatory view illustrating an aspect where the image formation section is positioned relative to the intermediate transfer belt unit.

FIGS. 9 to 11 are explanatory views of intermediate transfer belt unit 700. FIG. 9 is a perspective view of intermediate transfer belt unit 700 seen from the upper side. FIG. 10 is a perspective view of intermediate transfer belt unit 700 seen from the lower side, and FIG. 11 an explanatory view illustrating an aspect where image formation section 400 is positioned relative to intermediate transfer belt unit 700.

Intermediate transfer belt unit 700 is configured to include, as illustrated in FIG. 1 and the like, belt frame 708, drive roller 702 rotatably supported by belt frame 708, tension roller 703, and intermediate transfer belt 701, or the like. Protrusion reception parts 708*a*F and 708*a*R are provided on the upper portions of side plates 711*a*, 711*b* of belt frame 708. Protrusion reception parts 708*a*F and 708*a*R are configured to include V-character grooves into which protrusion parts 409, described above, of image formation section 400 are fitted. Four sets of protrusion reception parts 708*a*F and 708*a*R are provided corresponding to four image formation units 400K, 400Y, 400M, and 400C. Protrusion parts 409 of four image formation units 400K, 400Y, 400M, and 400C are respectively fitted into respective sets of protrusion reception parts 708*a*F and 708*a*R, so that respective image formation units 400K, 400Y, 400M, and 400C are positioned.

Belt frame 708 is provided with positioning pins 709L, 709R, 710L, and 710R. Respective positioning pins 709L, 709R, 710L, and 710R are respectively fitted into engagement holes 902*c*L, 902*c*R, 903*c*L, and 903*c*R of main body frame 900. In this way, intermediate transfer belt unit 700 is accurately positioned and held relative to main body frame 900.

Figure 12:
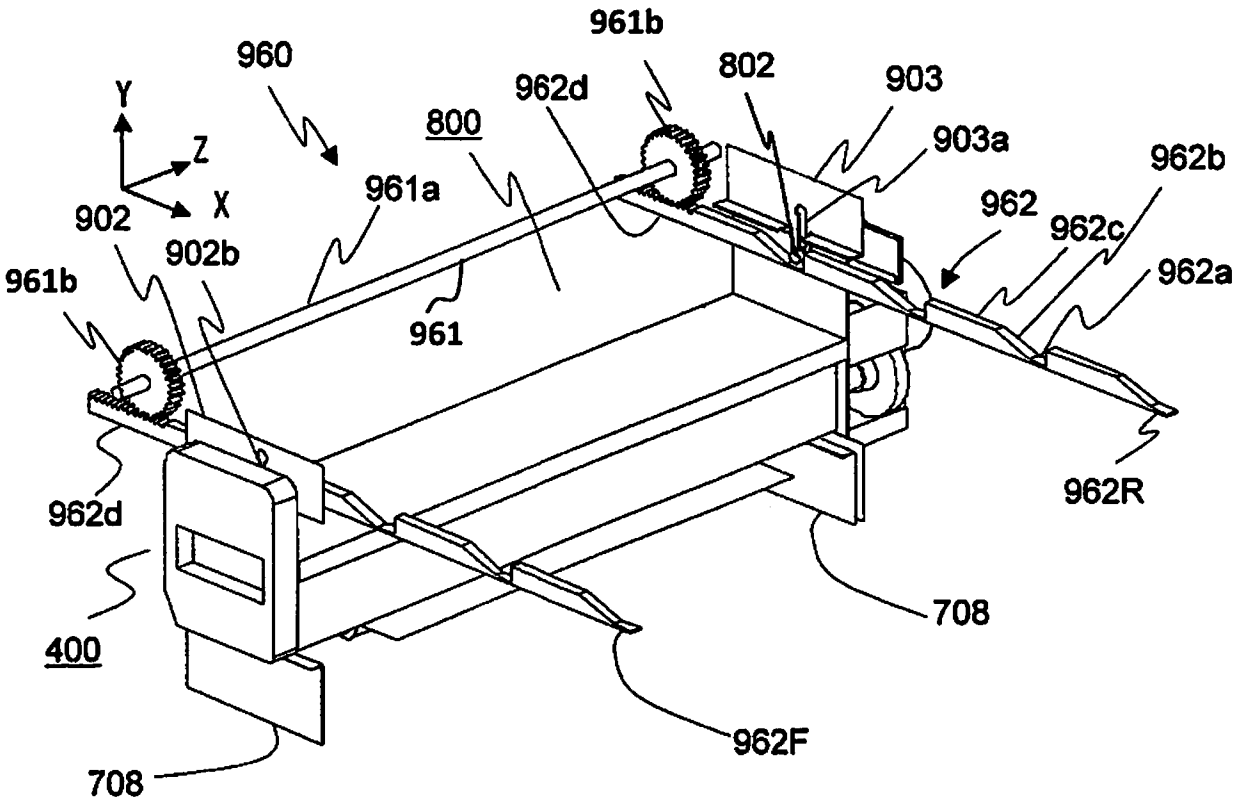
FIG. 12 is a perspective view illustrating a state where the image formation section is mounted to the rail unit from the upper side.
Figure 13:
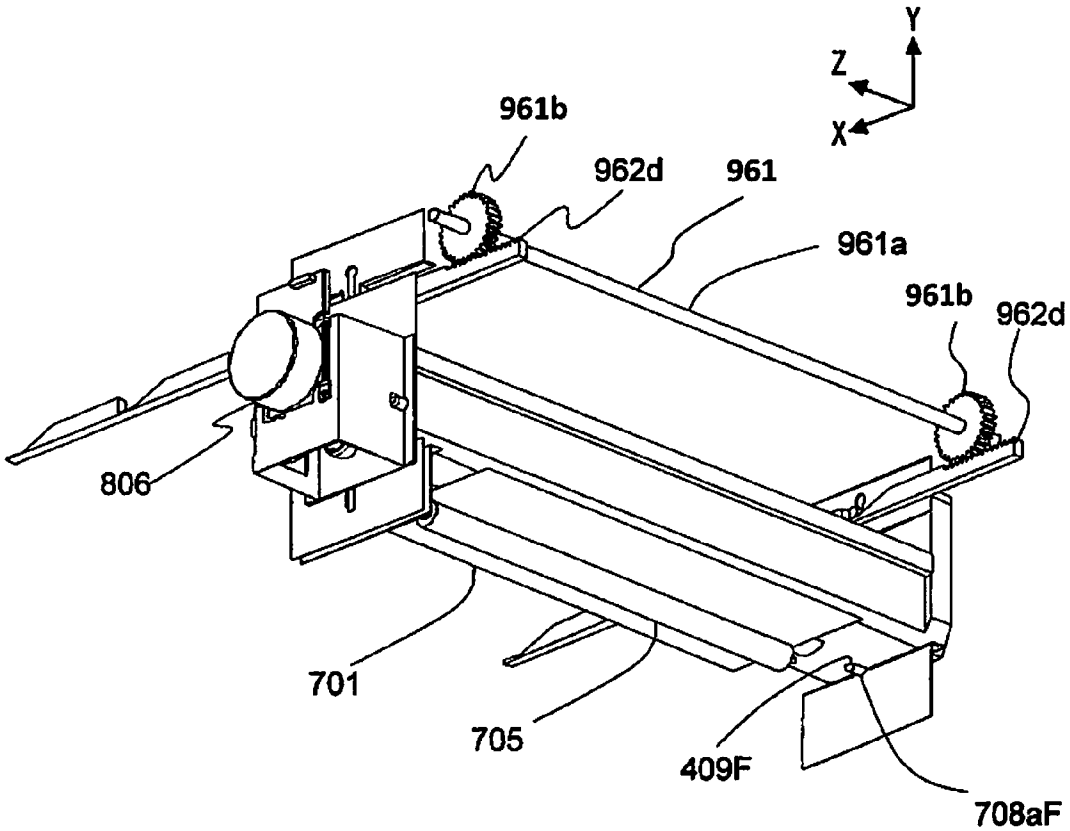
FIG. 13 is a perspective view illustrating the state where the image formation section is mounted to the rail unit from the lower side.
Figure 14:
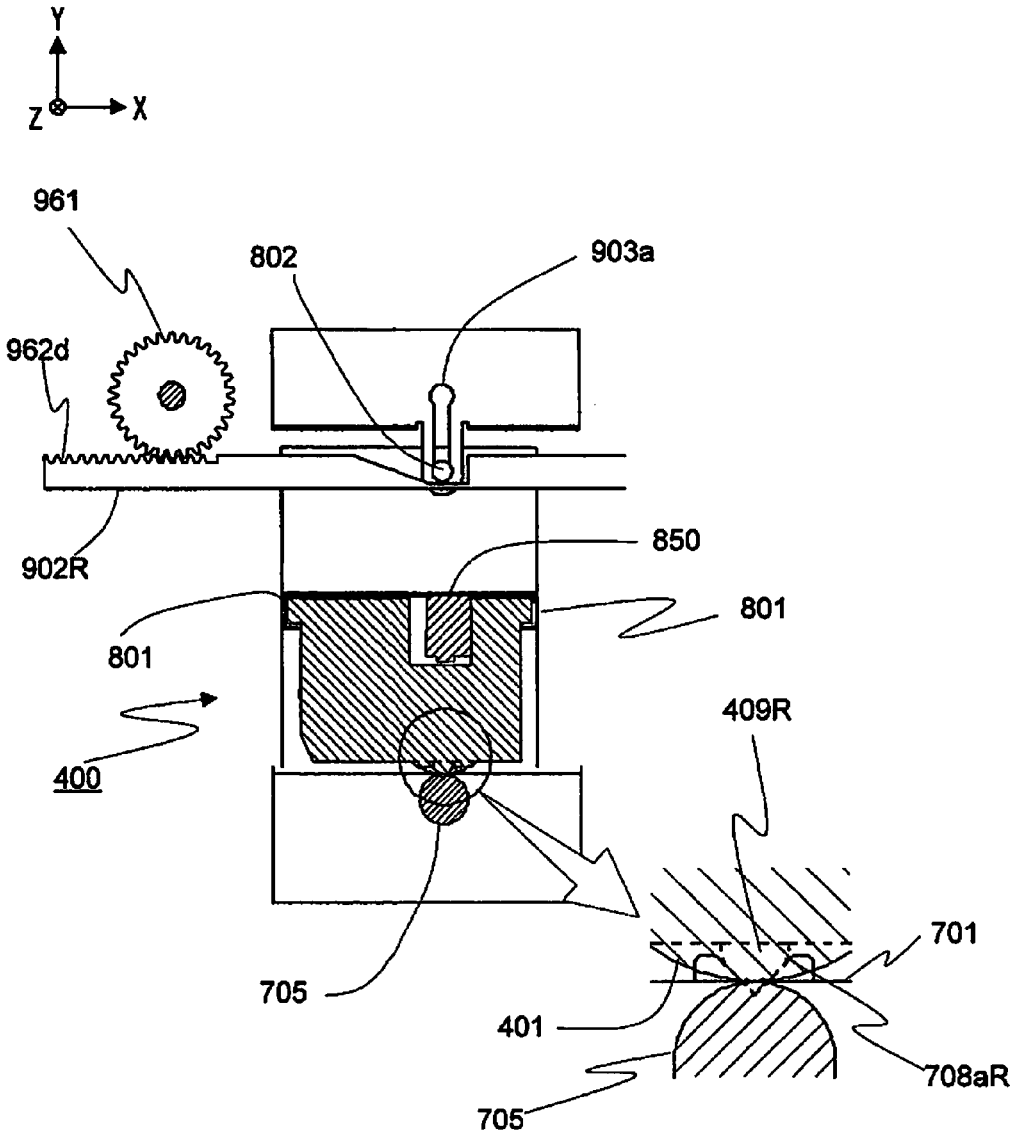
FIG. 14 is a side cross-sectional view illustrating the state where the image formation section is mounted to the rail unit.
Figure 15:
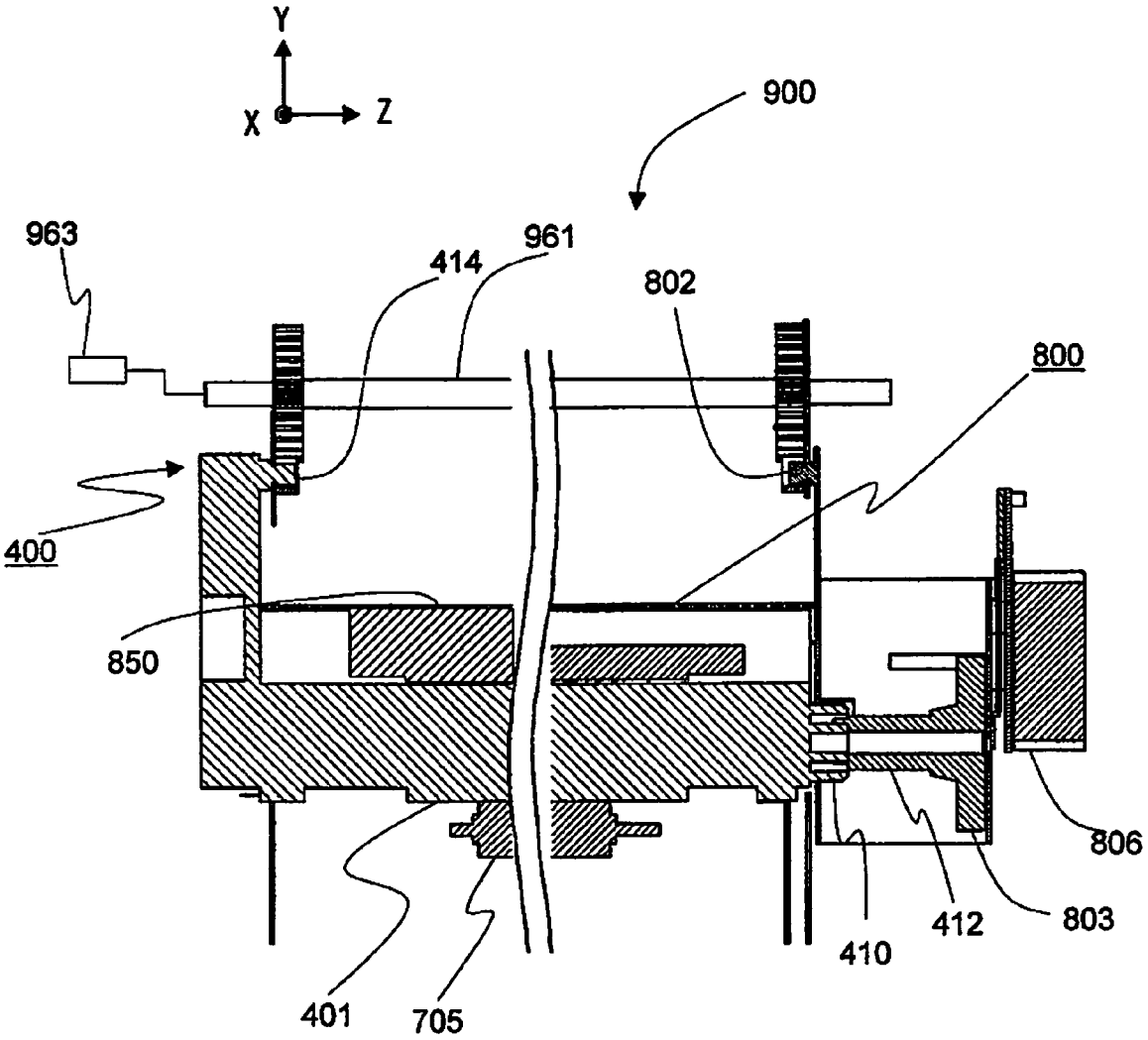
FIG. 15 is a front cross-sectional view illustrating the state where the image formation section is mounted to the rail unit.

FIGS. 12 to 15 are views explaining a state where image formation section 400 is mounted to rail unit 800. FIG. 12 is a perspective view illustrating the state where image formation section 400 is mounted to rail unit 800 from the upper side. FIG. 13 is a perspective view illustrating the state where image formation section 400 is mounted to rail unit 800 from the lower side. FIG. 14 is a side cross-sectional view illustrating the state where image formation section 400 is mounted to rail unit 800, and FIG. 15 is a front cross-sectional view illustrating the state where image formation section 400 is mounted to rail unit 800.

Here, rail unit 800 before image formation section 400 is mounted thereto, and is held at a position opposed to opening unit 902*b* of main body frame 900. Thereby, guide pin 802 formed on rail unit 800 is engaged with the lower end of long hole 903*a* formed on main body frame 900, and pins 807 formed on rail unit 800 is engaged with the lower end of long holes 902*e* formed on main body frame 900.

Next, when image formation units 400K, 400Y, 400M, and 400C are mounted to rail units 800 held by main body frame 900, each image formation unit 400K, 400Y, 400M, or 400C is inserted from opening unit 902*b* in the plus-Z direction. In this case, rail unit 408 of each image formation unit 400K, 400Y, 400M, or 400C is inserted in the plus-Z direction along rail support part 801 of rail unit 800. In this manner, image formation units 400K, 400Y, 400M, and 400C are mounted to rail units 800 and main body frame 900.

In addition, guide pin 802 of rail unit 800 is engaged with long hole 903*a* on rear plate 903 of main body frame 900. Positioning pin 414 of image formation section 400 is engaged with long hole 902*d* on front plate 902. Accordingly, main body frame 900 supports image formation section 400 integral with rail units 800 to be movable in the upper and lower direction. Guide pin 802 and positioning pin 414 are disposed in such a manner to be opposed to slider 962 of lift mechanism 960 as a switching unit. Lift mechanism 960 shifts image formation section 400 together with rail unit 800 upwardly or downwardly to allow image formation section 400 to be moved to an image formation position and a non-image formation position as appropriate.

Moreover, as illustrated in FIG. 12, lift mechanism 960 is disposed in main body frame 900. Lift mechanism 960 is configured to include sliders 962, drive motor 963 as a slider drive unit which drives slider 962, and slider gear 961 for transmitting the drive of drive motor 963 to slider 962.

Sliders 962 are respectively disposed inside front plate 902 and rear plate 903 of main body frame 900 in the longitudinal direction of image formation units 400K, 400Y, 400M, and 400C, on both end sides.

Lift mechanism 960 is a switching unit which moves four image formation units 400K, 400Y, 400M, and 400C of image formation section 400 to an image formation position (printing position) and a non-image formation position (standby position).

Moreover, each slider 962 includes bottom parts 962*a* for supporting respective image formation units 400K, 400Y, 400M, and 400C in the image formation positions, upper surface parts 962*c* for supporting these image formation units in the non-image formation positions, slant parts 962*b* each of which connects upper surface part 962*c* and bottom part 962*a*, and rack 962*d* provided on one end. Slider 962 is mounted to main body frame 900 to be slidable in the Z direction relative to main body frame 900. Specifically, in a state where image formation section 400 and rail unit 800 are integrally mounted to main body frame 900, two sliders 962 are disposed in such a manner to be respectively located at the lower side of positioning pin 414 of image formation section 400, and at the lower side of guide pin 802 of rail unit 800.

Slider gear 961 is a gear for sliding respective sliders 962 in the X-axis direction by being meshed with racks 962*d* of respective sliders 962. Slider gear 961 is configured to include two pinion gears 961*b* provided on both sides of rotation shaft 961*a*. Two pinion gears 961*b* respectively mesh with racks 962*d* of respective sliders 962.

Drive motor 963 is a motor for rotationally driving slider gear 961. Drive motor 963 is connected to rotation shaft 961*a*. Drive motor 963 is connected to the controller.

Accordingly, drive motor 963 rotationally drives slider gear 961, so that respective sliders 962 move as appropriate between a standby state and a function state. Specifically, the image formation position indicates a state where guide pin 802 and positioning pin 414 are located at positions opposed to bottom part 962*a* of slider 962 with a certain interval therebetween (the state of FIG. 12). In this case, as in FIG. 14, protrusion parts 409F and 409R of image formation section 400 are engaged with V-groove shaped protrusion reception parts 708*a*F and 708*a*R formed on belt frame 708 of intermediate transfer belt unit 700, so that image formation section 400 is accurately positioned. Moreover, from this state, when drive motor 963 rotationally drives slider gear 961 to slide respective sliders 962, image formation section 400 is moved to the non-image formation position. In other words, when respective sliders 962 are slid, guide pin 802 and positioning pin 414 are lifted up with slant part 962*b* of slider 962, and are located at positions to be abutted on upper surface part 962*c*. Accordingly, image formation section 400 is moved to the non-image formation position separated from the intermediate transfer belt unit 700. Note that, the shape of upper surface part 962*c* or the like of slider 962 is set corresponding to printing modes. For example, in a color printing mode, the shape of upper surface part 962*c* or the like is set in such a manner to move all of four image formation units 400K, 400Y, 400M, and 400C to the image formation positions. Differently in a monochrome printing mode, the shape of upper surface part 962*c* or the like is set in such a manner to move, among four image formation units 400K, 400Y, 400M, and 400C, only image formation unit 400K to the image formation position.

[Operation]

The image formation apparatus of the above mentioned configuration operates as follows. The operation is described on the basis of FIGS. 16 to 21.

When the controller issues a printing instruction, respective image formation units 400K, 400Y, 400M, and 400C are operated as appropriate in accordance with the printing content to perform printing.

In the case of color printing, the controller controls drive motor 963 to rotationally drive slider gear 961, so that respective sliders 962 slide to move all of image formation section 400 (four image formation units 400K, 400Y, 400M, and 400C) to the image formation positions. Meanwhile, in the case of monochrome printing, slider gear 961 is driven, and respective sliders 962 slide to move three image formation units 400Y, 400M, and 400C to the non-image formation positions. In other words, sliders 962 slide to lift, from a state of FIGS. 16, 18, and 19, (plus Y-axis direction) guide pin 802 and positioning pin 414 upward, respectively supported by long holes 903*a* and 902*d* with slant parts 962*b* of sliders 962. In addition, sliders 962 are further moved to place guide pin 802 and positioning pin 414 on upper surface part 962*c* of slider 962, as in FIGS. 17, 20, and 21. Accordingly, image formation units 400Y, 400M, and 400C, which are not used in the monochrome printing, move upward (plus Y-axis direction) with rail units 800. The image formation units are supported at positions (non-image formation positions) separated from photoconductive drums 401 of respective image formation units, 400Y, 400M, and 400C and intermediate transfer belt 701 of intermediate transfer belt unit 700.

Figure 16:
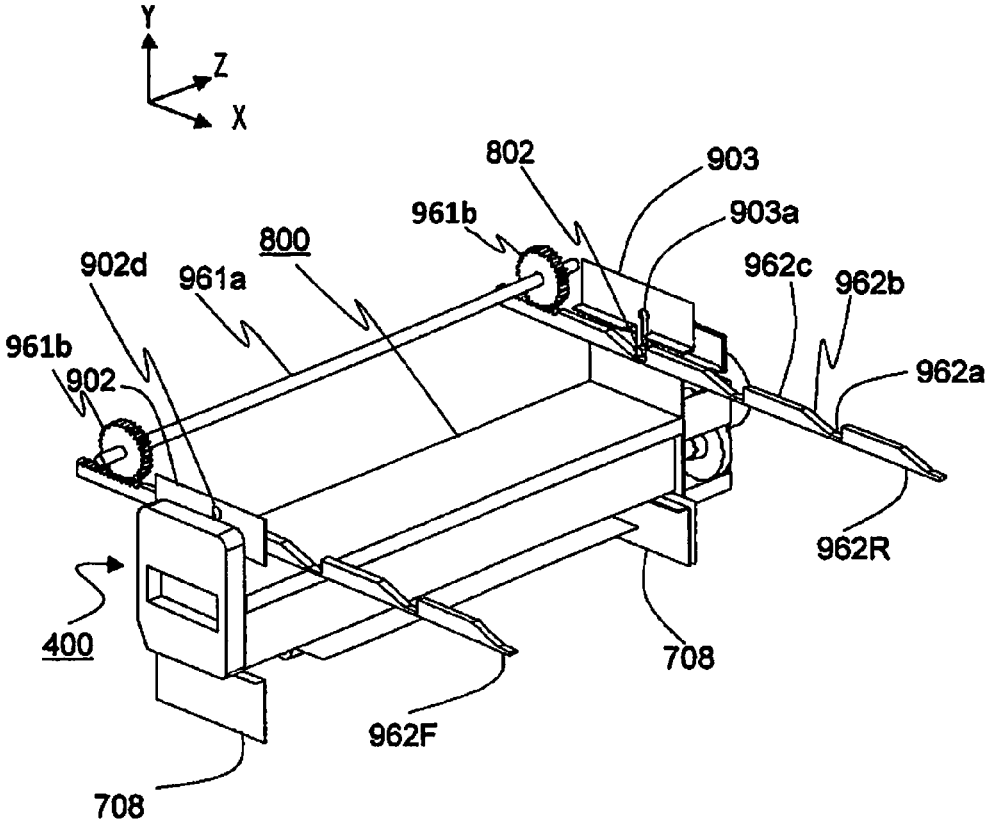
FIG. 16 is a perspective view illustrating the image formation section, the rail unit, and a lift mechanism.
Figure 17:
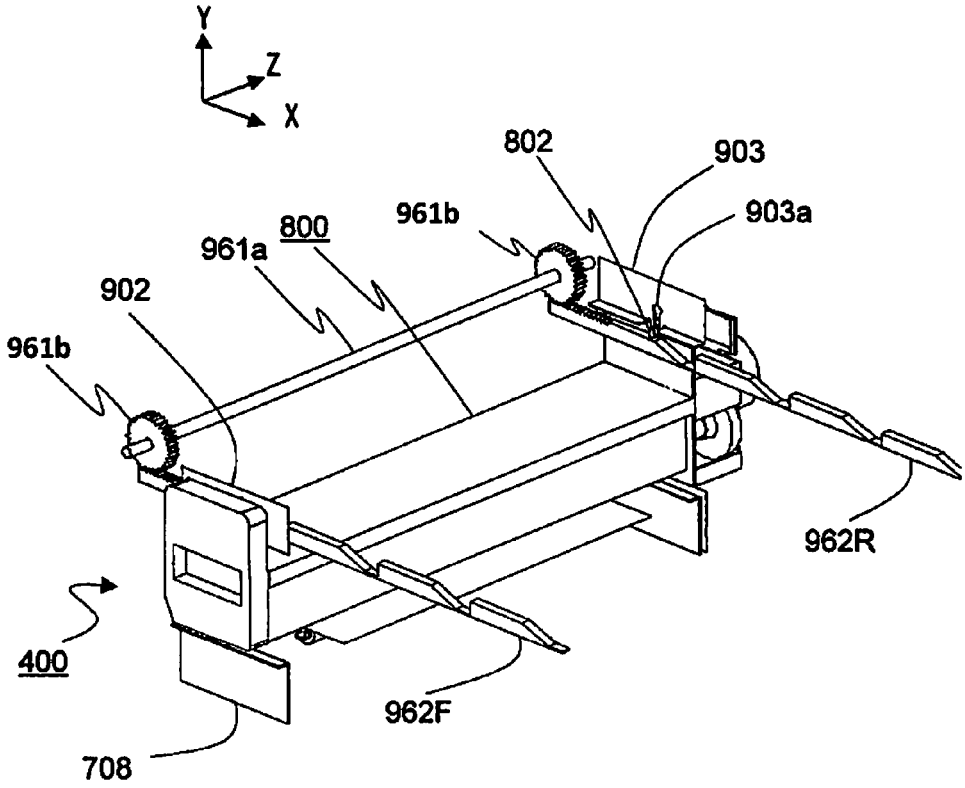
FIG. 17 is a perspective view illustrating a state where the lift mechanism of FIG. 16 is slid.
Figure 18:
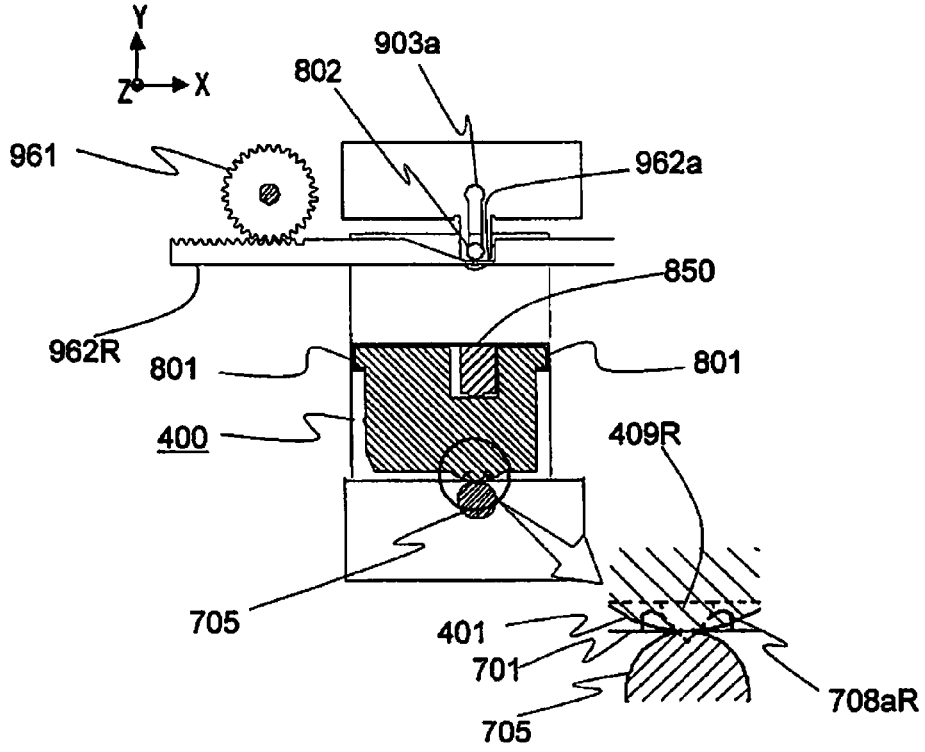
FIG. 18 is a side cross-sectional view illustrating the image formation section and the like of FIG. 16.
Figure 19:
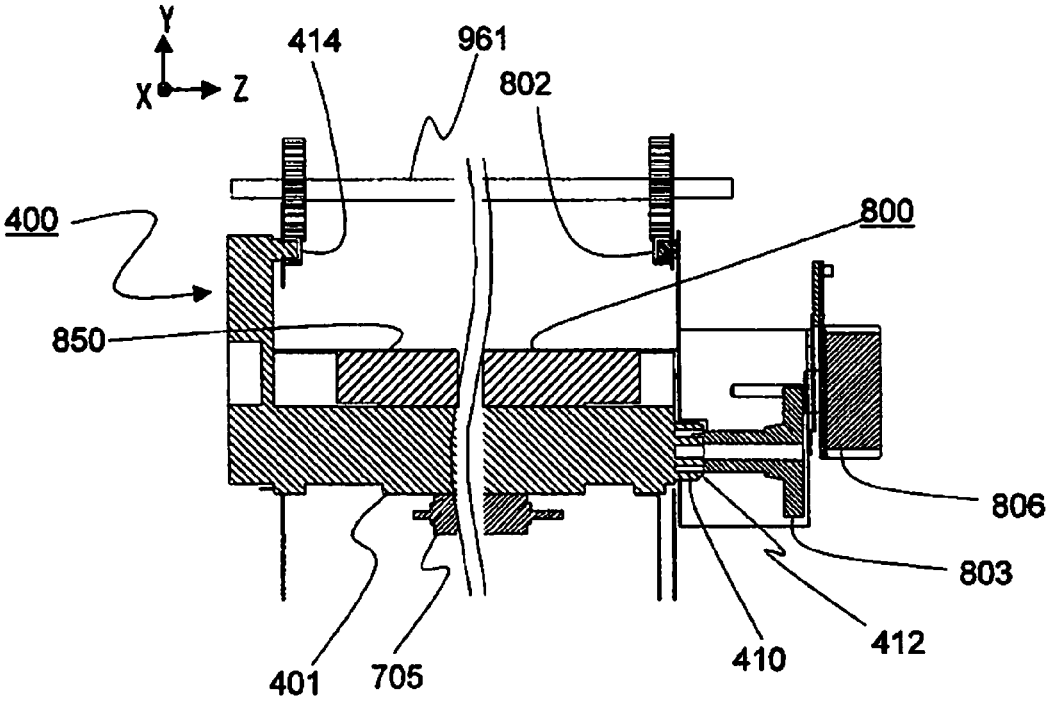
FIG. 19 is a front cross-sectional view illustrating the image formation section and the like of FIG. 18.
Figure 20:
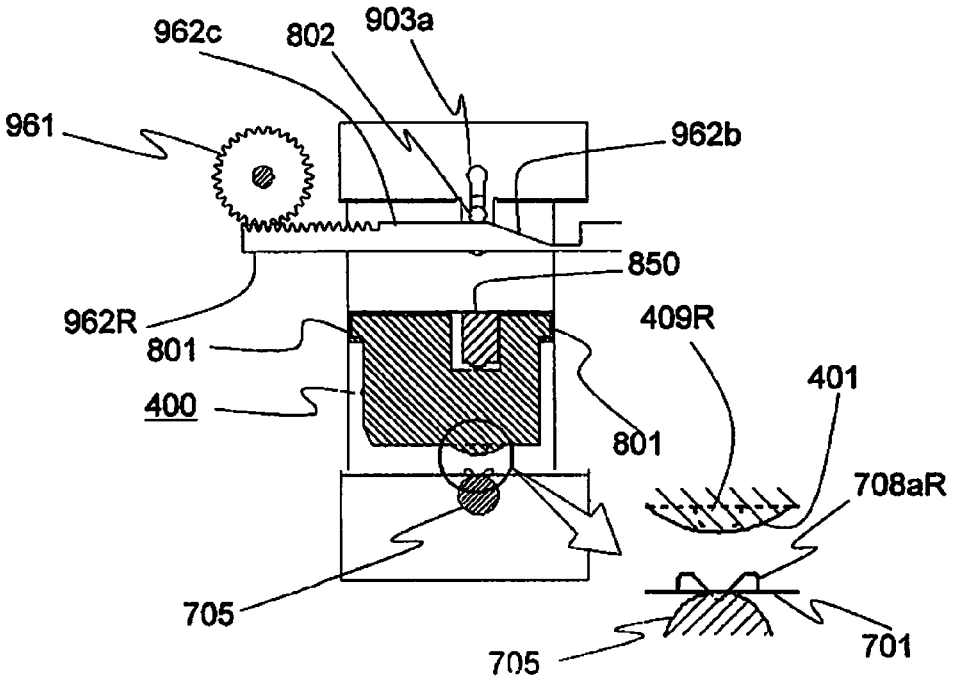
FIG. 20 is a side cross-sectional view illustrating the image formation section and the like of FIG. 17.
Figure 21:
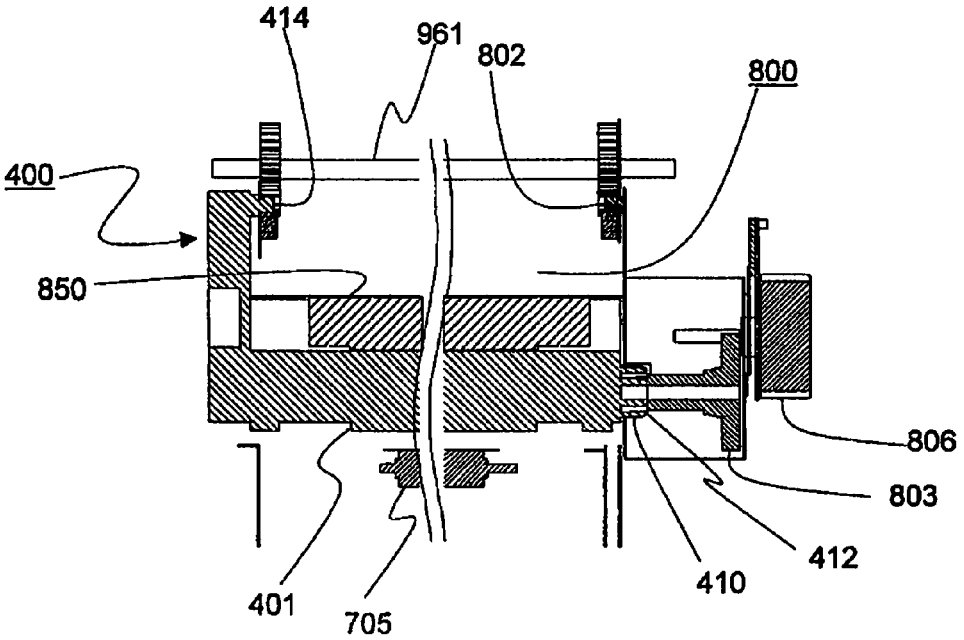
FIG. 21 is a front cross-sectional view illustrating the image formation section and the like of FIG. 20.

Meanwhile, when image formation section 400 (four image formation units 400K, 400Y, 400M, and 400C) is moved from the non-image formation position to the image formation position, sliders 962 are moved in a minus X-axis direction from the state of FIGS. 17, 20, and 21 to the state of FIGS. 16, 18, and 19. Guide pin 802 and positioning pin 414 are moved from upper surface part 962*c* to bottom part 962*a* of slider 962. In this case, in the upper portions of image formation units 400K, 400Y, 400M, and 400C and rail unit 800 which hold the image formation units, guide pins 802 and positioning pins 414 are respectively fitted into long holes 903*a* and 902*d* to provide the support. The lower portion of image formation section 400 is supported by protrusion parts 409F and 409R that are engaged with V-groove shaped protrusion reception parts 708*a*F and 708*a*R formed on belt frame 708 of intermediate transfer belt unit 700. Accordingly, image formation section 400 is easily and accurately positioned relative to intermediate transfer belt unit 700. In this case, a drive transmission unit of motor 806 which drives photoconductive drum 401 is connected to photoconductive drum 401 all the time in either case where image formation section 400 is at the image formation position and at the non-image formation position. In the absence of aspects of the invention, when image formation units 400K, 400Y, 400M, and 400C are moved from the image formation positions to the non-image formation positions, the temporary release of drive transmission from the drive motor to photoconductive drum 401 results in the generation of a jitter or the like in the drive system of a gear or the like, and this becomes a factor of lowering the image quality. However, with the configuration according to the embodiment, the generation of such a factor can be reduced. Therefore, the image quality can be improved.

In the case of color printing, drive motor 963 which drives sliders 962 is controlled by a controller, which is not illustrated, such that respective image formation units 400K, 400Y, 400M, and 400C abut on intermediate transfer belt 701. In the case of monochrome printing, drive motor 963 which drives sliders 962 is controlled by the controller, which is not illustrated, such that only image formation unit 400K abuts on intermediate transfer belt 703.

Next, photoconductive drum 401 disposed in each of the image formation units is charged by charge roller 402, and exposure device 850 performs exposures on the basis of printing data to form an electrostatic latent image on photoconductive drum 401. Development roller 404 receives toner supplied from supply roller 403, and develops with the toner the electrostatic latent image formed on photoconductive drum 401 to form a toner image on photoconductive drum 901. Transfer roller 705 performs a primary transfer of the toner image formed on photoconductive drum 401 onto intermediate transfer belt 701. Drum cleaner 405 cleans the toner remaining on photoconductive drum 401 after the primary transfer.

Moreover, pickup roller 202 supplies printing paper sheets 101 stacked on paper tray 100 to feed roller 203 and retard roller 204. Feed roller 203 and retard roller 204 isolate printing paper sheets 101 as media thus supplied by pickup roller 202 one by one, and pairs of conveyance rollers 302, 304, and 305 convey the medium thus isolated to secondary transfer roller 707 and secondary transfer backup roller 704.

Thereafter, the respective rollers are controlled by a controller, which is not illustrated, such that the supplied medium and the toner image from the primary transfer onto intermediate transfer belt 701 are conveyed to the position of secondary transfer backup roller 704 and secondary transfer roller 707 with the same timing, on the basis of a detection of positions by sensors 301, 303, and 306.

Secondary transfer roller 707 and secondary transfer backup roller 704 secondarily transfer the toner image onto the printing paper sheet conveyed to secondary transfer roller 707 and secondary transfer backup roller 704.

Thereafter, printing paper sheet 101 on which the toner image is formed is conveyed to fixation unit 500, and the toner image on printing paper sheet 101 is fixed. After the fixation, printing paper sheet 101 is discharged to stacker unit 505 by pairs of conveyance rollers 504*a*, 504*b*, 504*c*, and 504*d*. Paper sensor 506 detects printing paper sheet 101 after the fixation, and detects that printing paper sheet 101 passes through fixation unit 500.

[Effect]

With the image formation apparatus of the above mentioned configuration, because rail unit 800 as a holder is provided with motor 806 as a drive unit, motor 806 and photoconductive drum 401 are not separated from each other when being moved between the image formation position and the non-image formation position. In other words, rail unit 800 can move, while holding image formation section 400 including photoconductive drum 401 as an image carrier to which the driving is transmitted from motor 806, from a first position (image formation position) where rail unit 800 abuts on intermediate transfer belt 701, to a second position (non-image formation position) where rail unit 800 separates from intermediate transfer belt 701, or from the second position to the first position.

This allows image formation section 400 to be moved from a first position where image formation section 400 abuts on intermediate transfer belt 701 to a second position where image formation section 400 separates from intermediate transfer belt 701, or from the second position to the first position, while keeping the connected state between drum drive gear 803 and joint 412. Accordingly, image formation section 400 operates stably.

As a result, when the monochrome printing mode is switched to the color printing mode, for example, no color shift or no phase shift occurs among the respective colors due to the backlash of the connection unit, and no adjustment process for again adjusting the phase shift is required. Accordingly, the printing position accuracy is kept with no lowered performance, and a high printing quality is maintained. Therefore, the reliability with respect to the image formation apparatus can be improved.

[Second Embodiment]

Next, a second embodiment according to the invention is described. Note that, the entire configuration of an image formation apparatus according to the embodiment is approximately similar to the image formation apparatus in the first embodiment. Therefore, the same reference numerals are assigned to the elements having the same configurations, and explanations thereof are omitted. Moreover, as for the operation and the effect, they are the same as those of the image formation apparatus in the first embodiment, and explanations thereof are also omitted.

Figure 22:
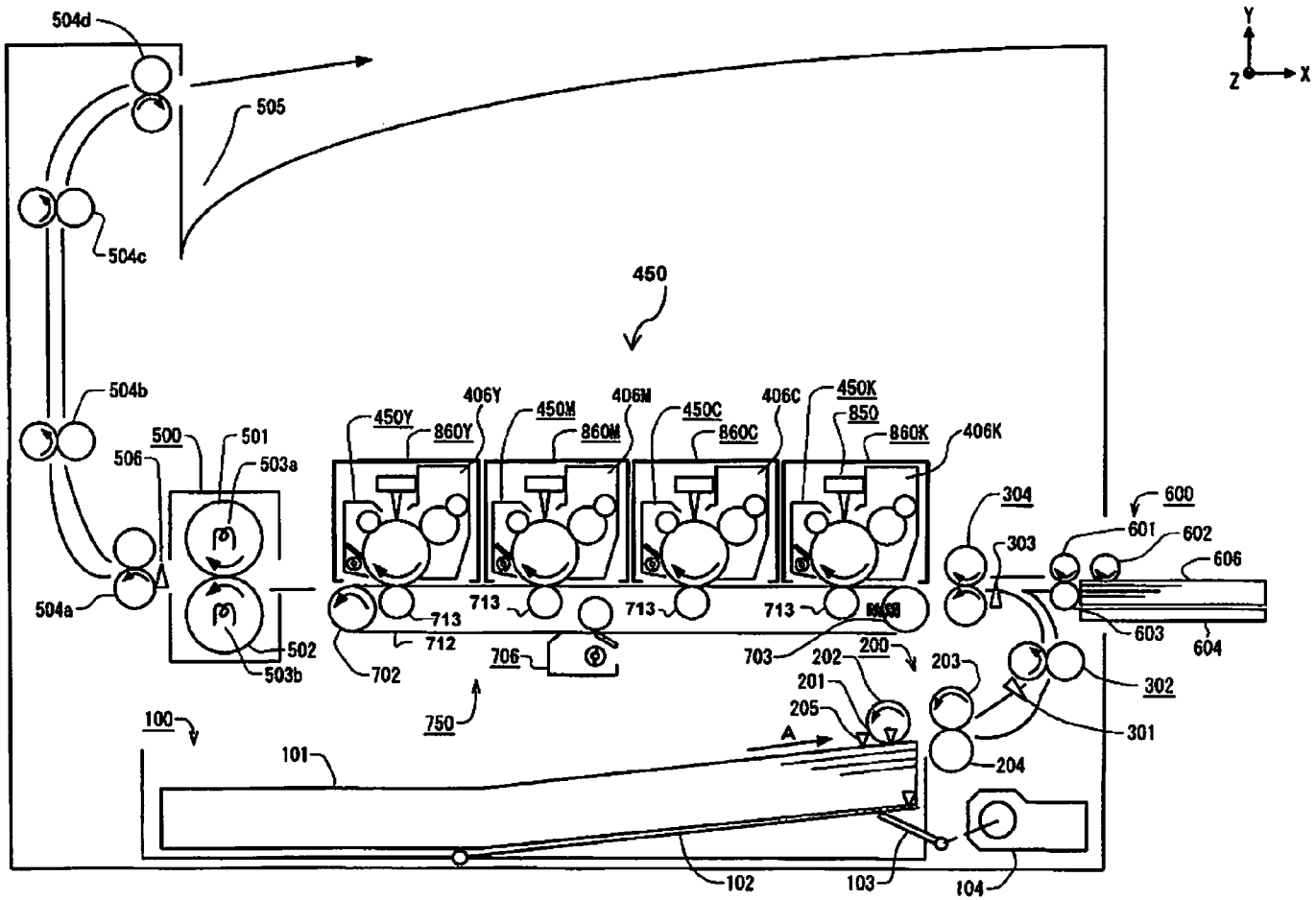
FIG. 22 is a schematic configuration view illustrating an image formation apparatus according to a second embodiment.

FIG. 22 is a schematic configuration view illustrating the image formation apparatus according to the second embodiment. In the image formation apparatus in the first embodiment, employed is a so-called intermediate transfer method in which a toner image formed by image formation section 400 is transferred onto intermediate transfer belt 701, and is transferred onto a printing medium from the intermediate transfer belt 701. Meanwhile, in the image formation apparatus in the second embodiment, a direct transfer method is employed in which a toner image formed by image formation section 450 is directly transferred onto a printing medium. In other words, a transfer medium is the intermediate transfer belt in the first embodiment, while a transfer medium is a printing paper sheet as a printing medium in the second embodiment.

Direct transfer belt unit 750 as a transfer unit in the second embodiment is configured to include drive roller 702, tension roller 703, conveyance belt 712, belt cleaner 706, transfer rollers 713, and the like. Moreover, in the second embodiment, toner storage units 406K, 406Y, 406M, and 406C are detachable to or fixed to image formation units 450K, 450Y, 450M, and 450C which constitute image formation section 450.

Figure 23:
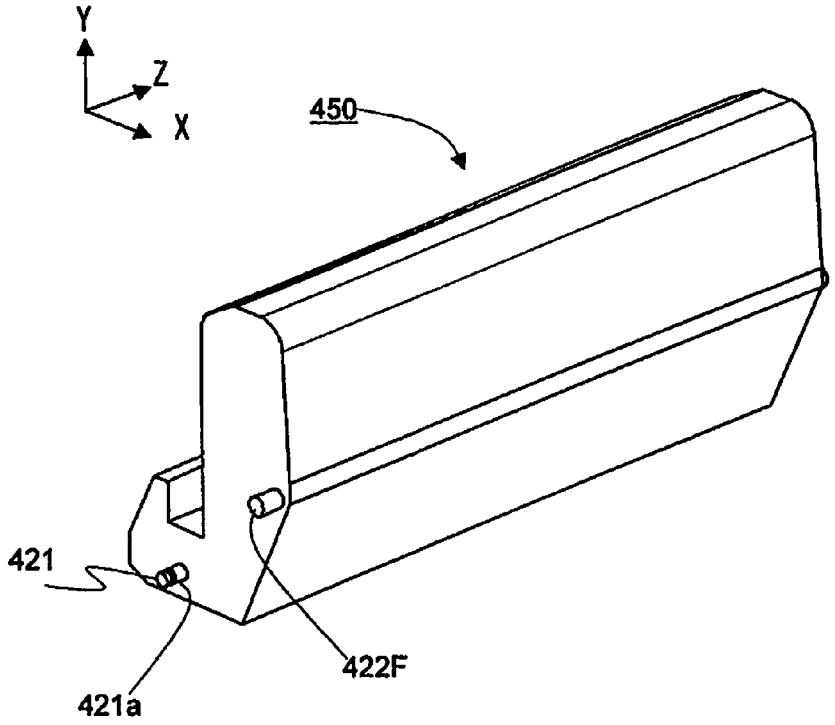
FIG. 23 is a perspective view of an image formation section according to the second embodiment seen from the upper side.
Figure 24:
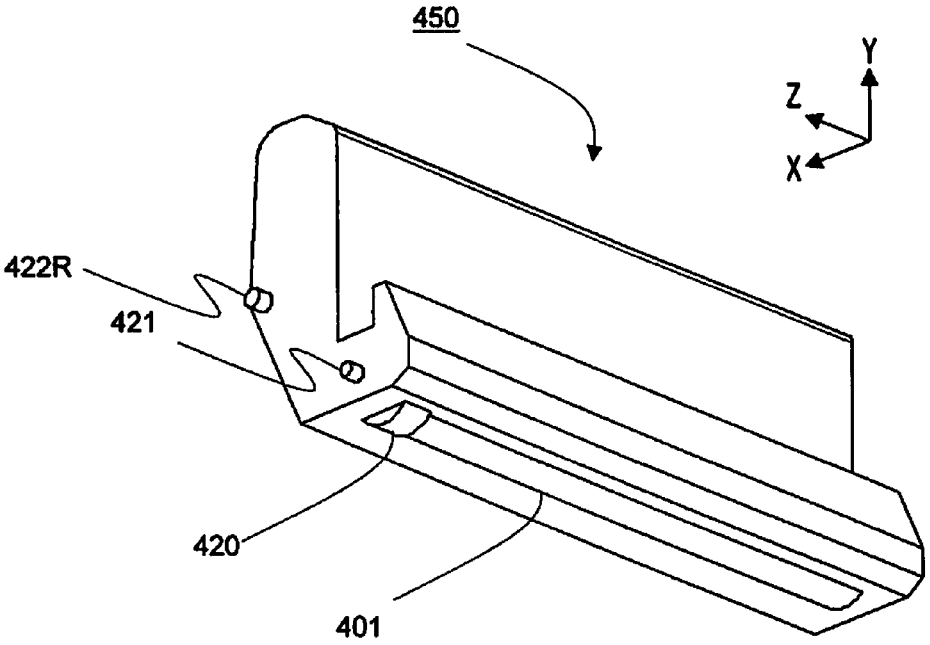
FIG. 24 is a perspective view of the image formation section according to the second embodiment seen from the lower side.

FIGS. 23 and 24 illustrate image formation section 450 according to the embodiment. FIG. 23 is a perspective view of image formation section 450 according to the embodiment seen from the upper side, and FIG. 24 is a perspective view of image formation section 450 according to the embodiment seen from the lower side.

Image formation section 450 includes, on the side face in the Y-axis direction, photoconductive drum 401 which is positioned when being mounted to an apparatus main body, drum shaft 421 coaxial therewith, pins 422F and 422R coaxial therewith, and drum gear 420 which are provided on one end of photoconductive drum 401 and are driven and transmitted by a drive unit, which is described later.

Figure 25:
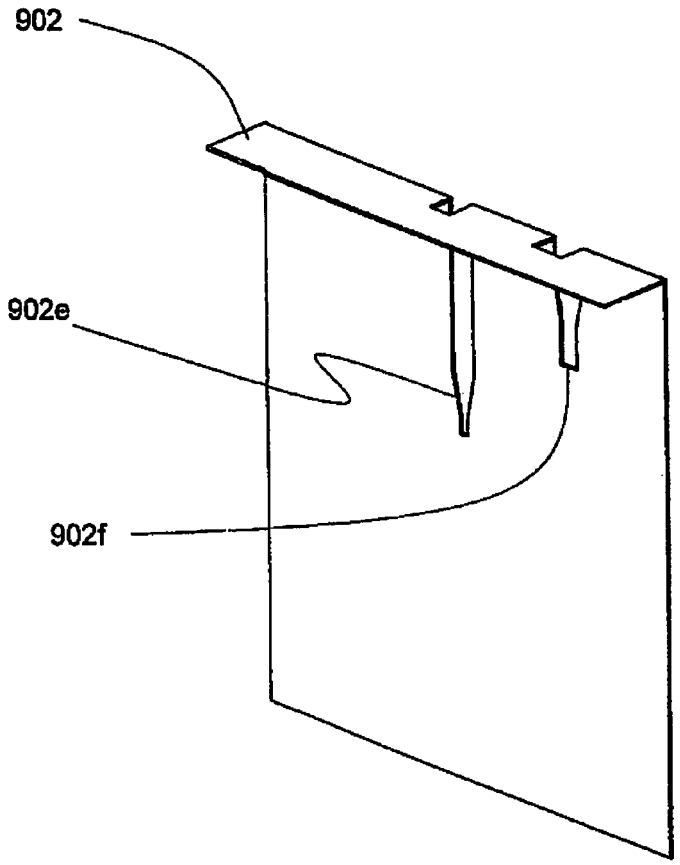
FIG. 25 is a perspective view illustrating a front plate.
Figure 26:
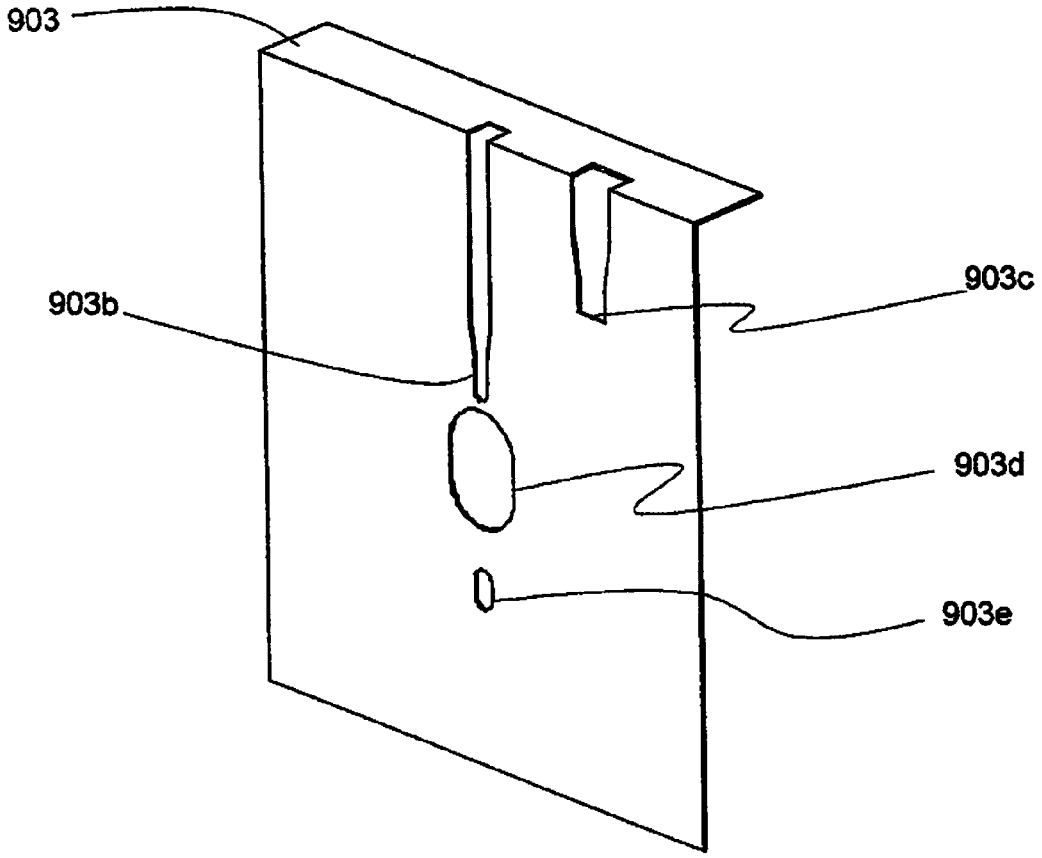
FIG. 26 is a perspective view illustrating a rear plate.

FIGS. 25 and 26 are explanatory views of a main frame of the apparatus main body. FIG. 25 is a perspective view illustrating front plate 902, and FIG. 26 is a perspective view illustrating rear plate 903.

Grooves 902*e* and 903*b* are respectively formed on Front plate 902 and rear plate 903. Grooves 902*e* and 903*b*, with which drum shaft 421 of image formation section 450 is engaged, regulate a position of image formation section 450 in the minus Y-axis direction and the X-axis direction, and are movable in the plus Y-axis direction. Moreover, grooves 902*f* and 903*c* are formed with which pins 422F and 422R of image formation section 450 are engaged. Image formation section 450 is attached or detached relative to front plate 902 and rear plate 903 from the upper side. Long hole 903*d*, through which drum drive gear 862 of motor unit 860 penetrates, which is described later, and long hole 903*e* with which motor unit 860 is positioned are formed on rear plate 903.

Figure 27:
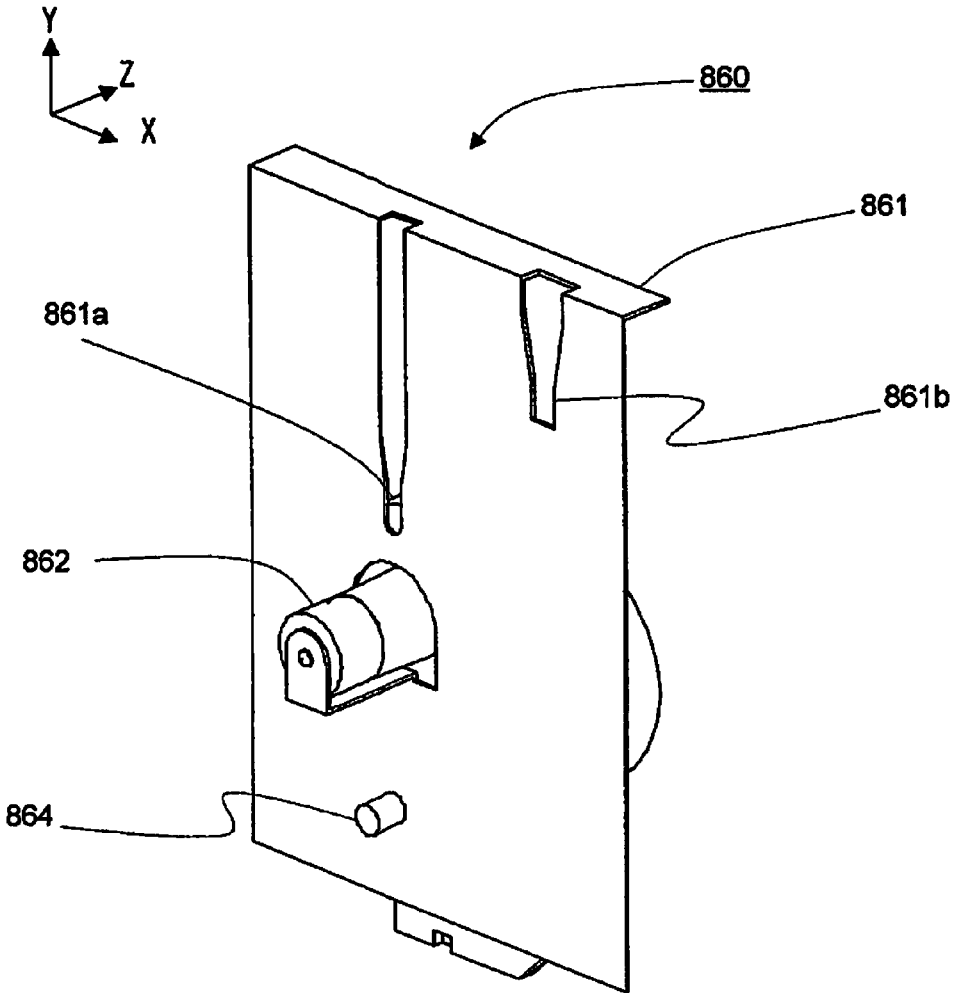
FIG. 27 is a perspective view of a motor unit seen from the inner side.
Figure 28:
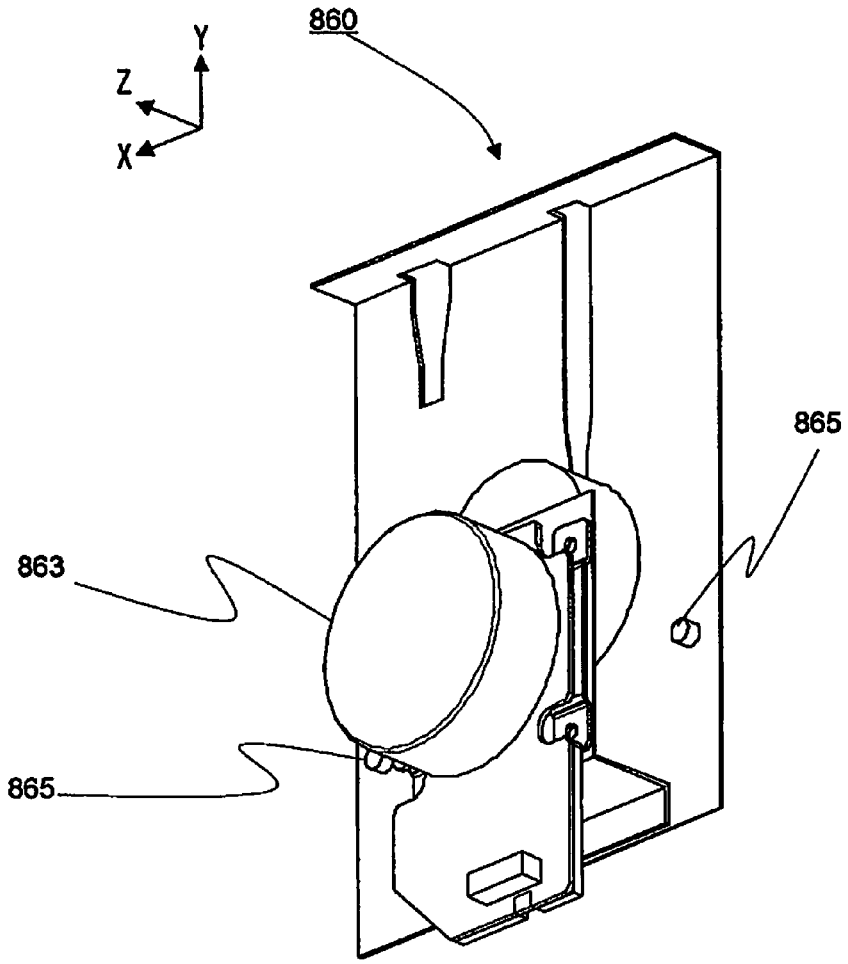
FIG. 28 is a perspective view of the motor unit seen from the outer side.
Figure 29:
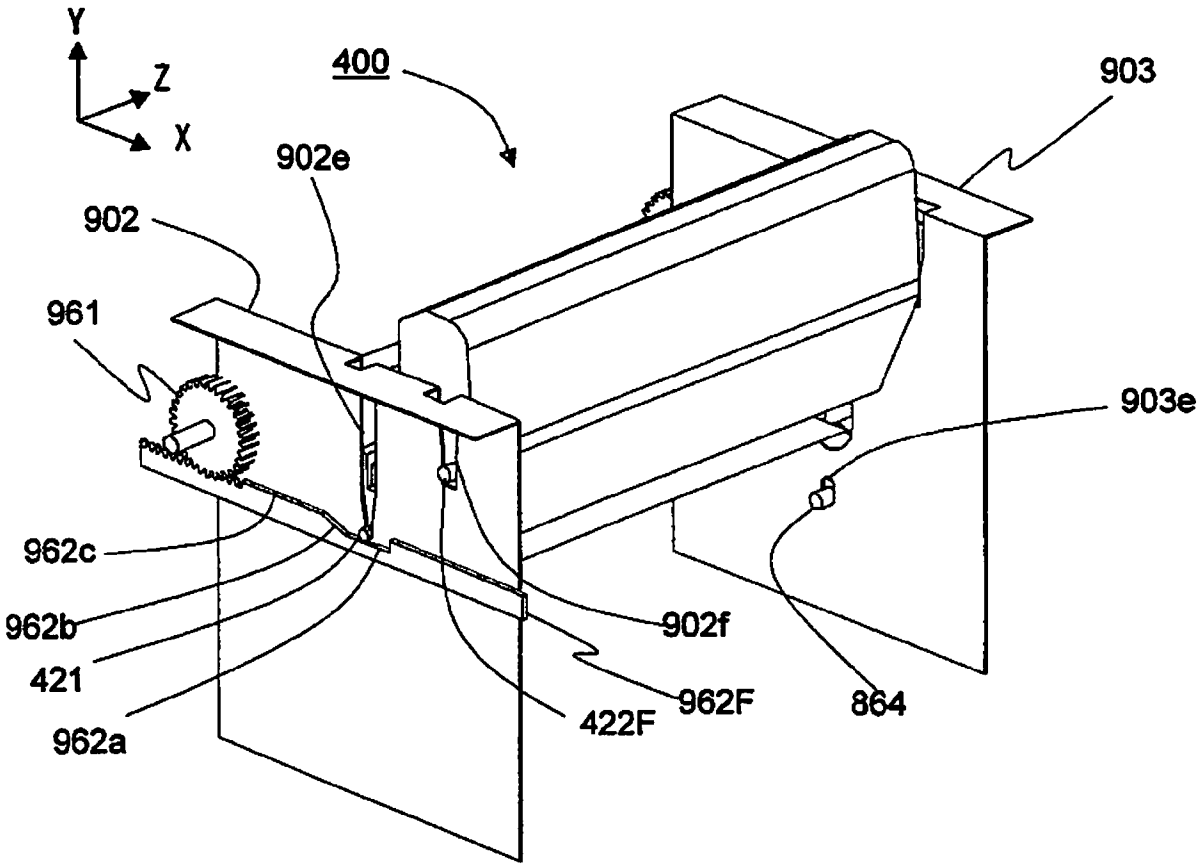
FIG. 29 is a perspective view from the rear upper side illustrating a state where the image formation section is attached to the front plate and the rear plate.
Figure 30:
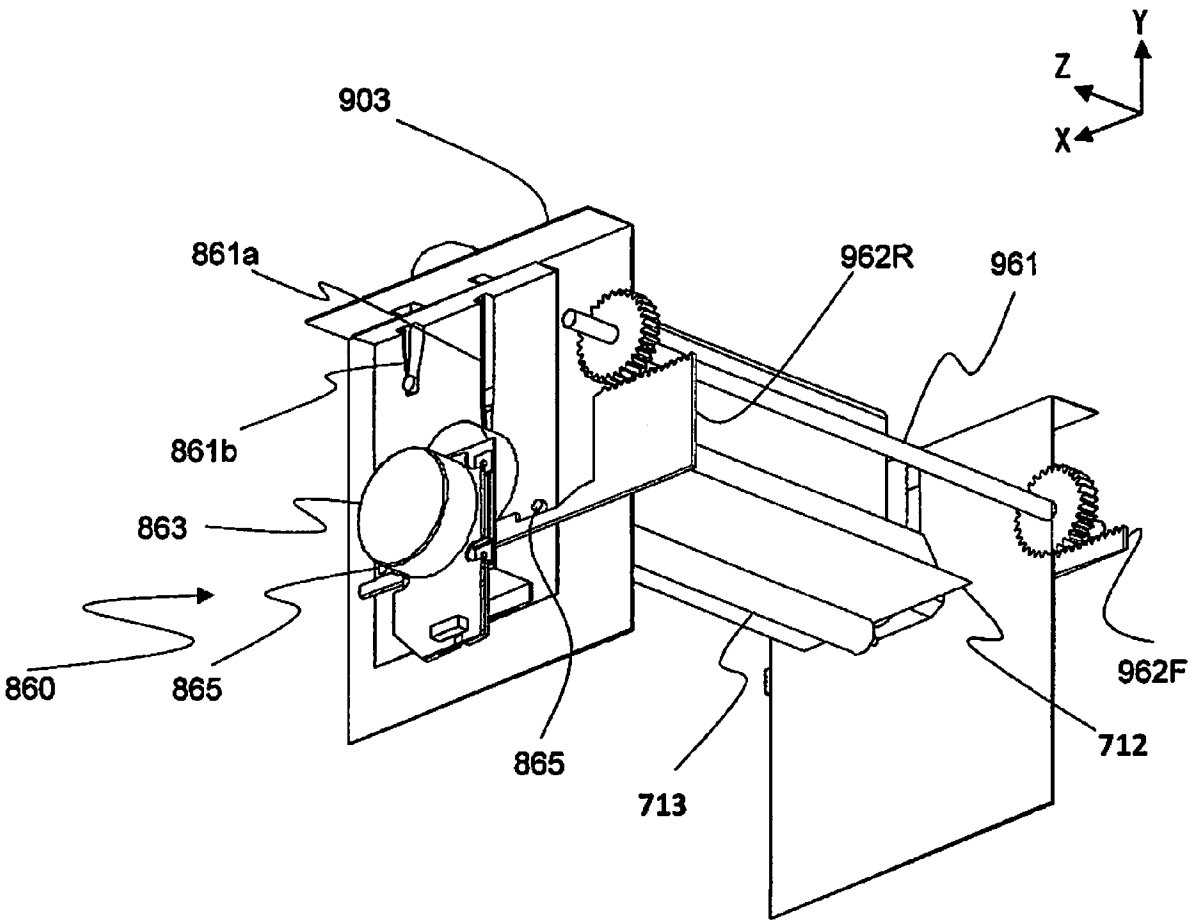
FIG. 30 is a perspective view from the front lower side illustrating the state where the image formation section is attached to the front plate and the rear plate.
Figure 31:
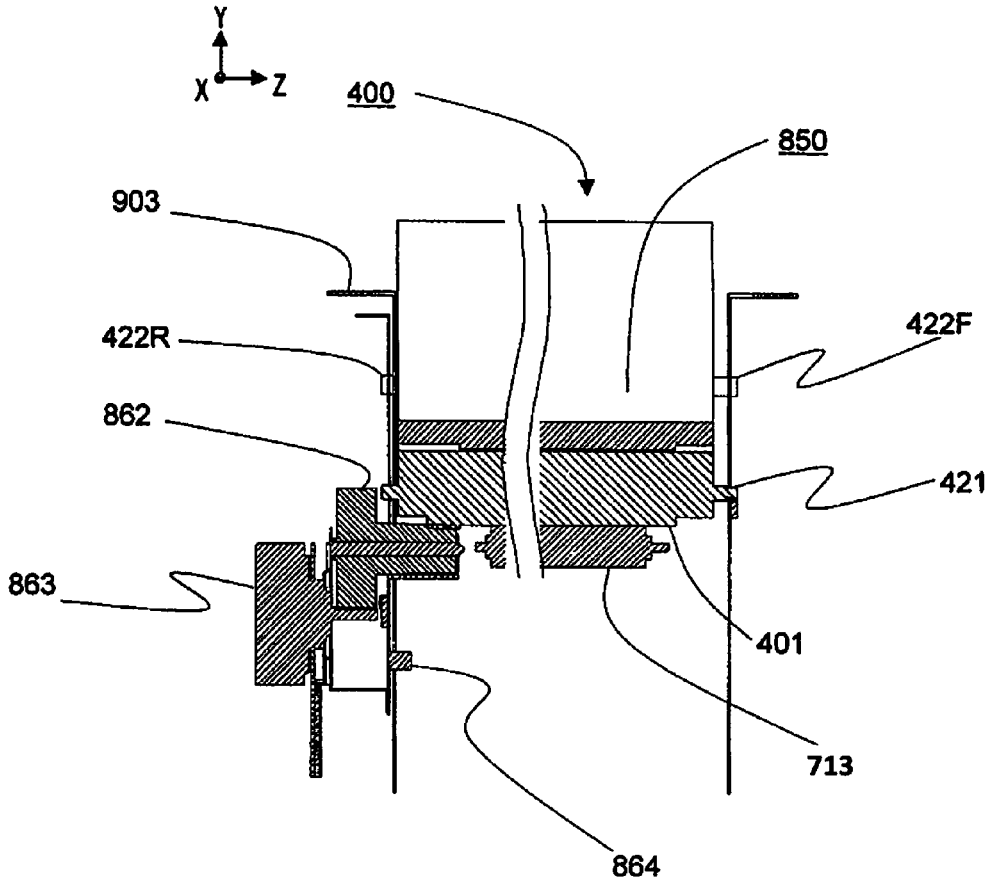
FIG. 31 is a side cross-sectional view illustrating the image formation section and the like of FIG. 29.
Figure 32:
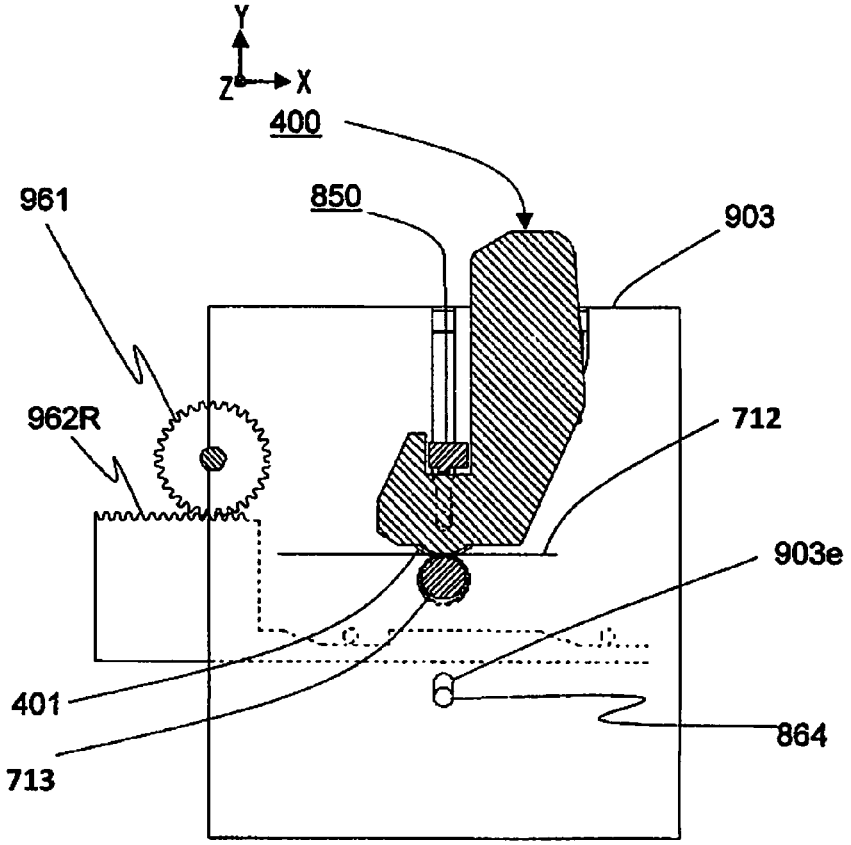
FIG. 32 is a front cross-sectional view illustrating the image formation section and the like of FIG. 31.
Figure 33:
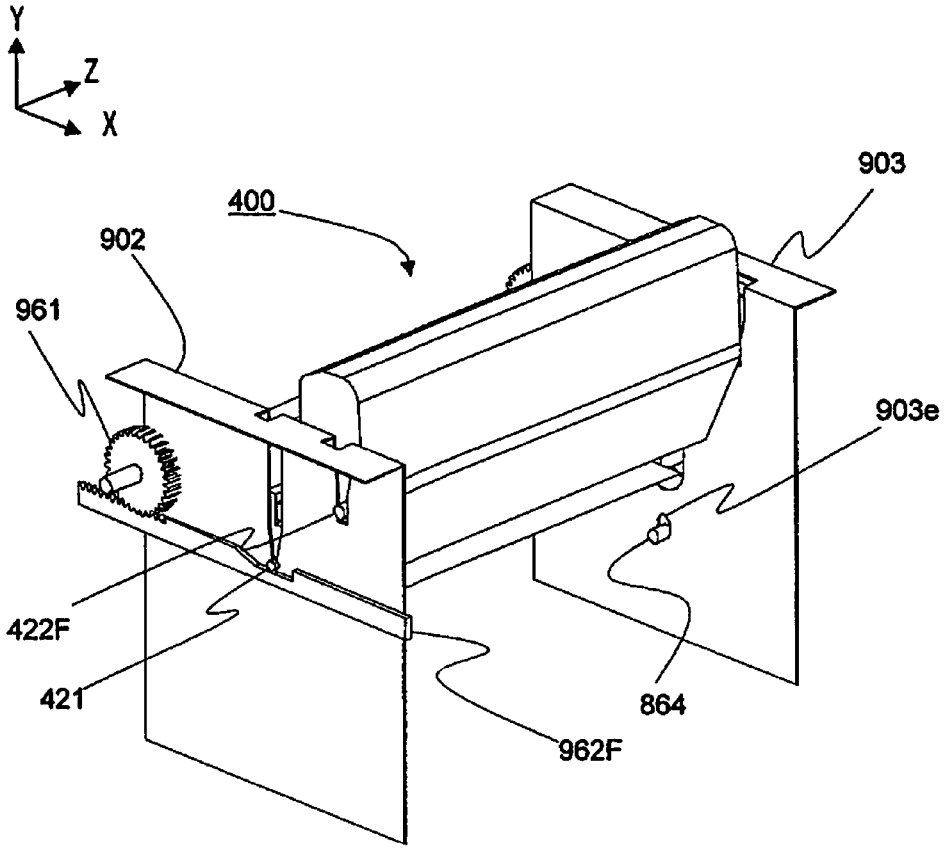
FIG. 33 is a perspective view from the rear upper side illustrating a state where the image formation section is attached to the front plate and the rear plate.
Figure 34:
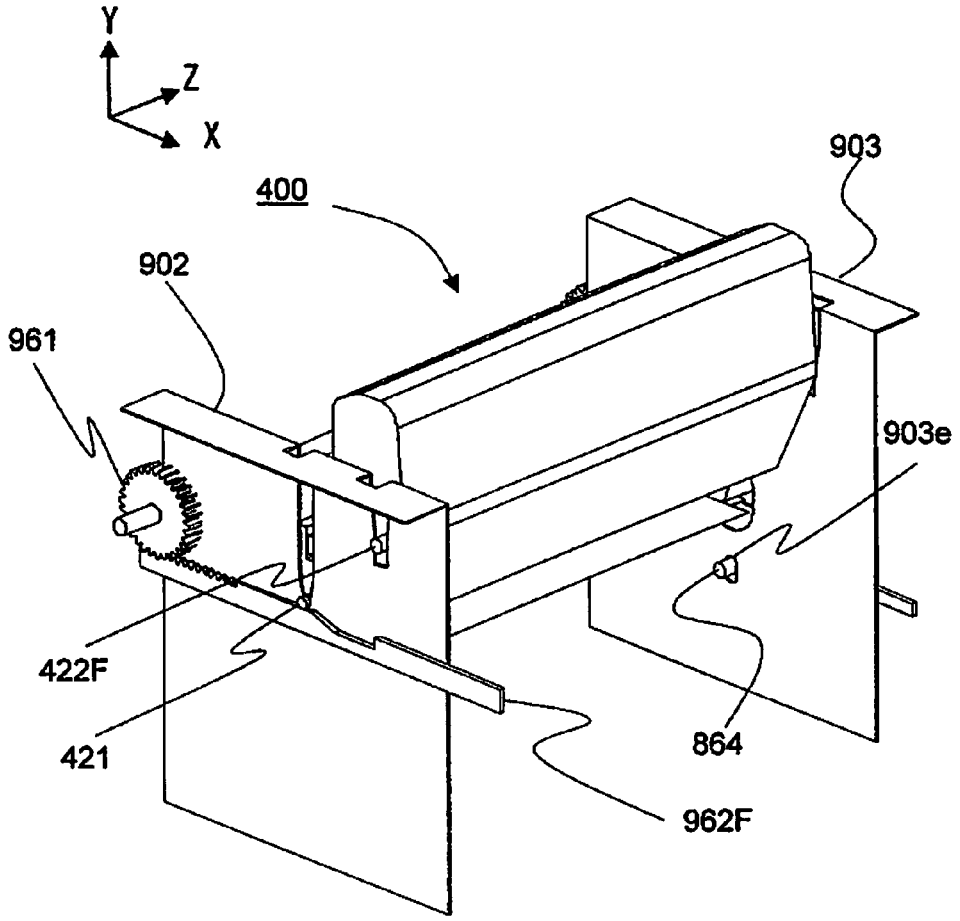
FIG. 34 is a perspective view illustrating another state where the image formation section is attached to the front plate and the rear plate from the rear upper side.
Figure 35:
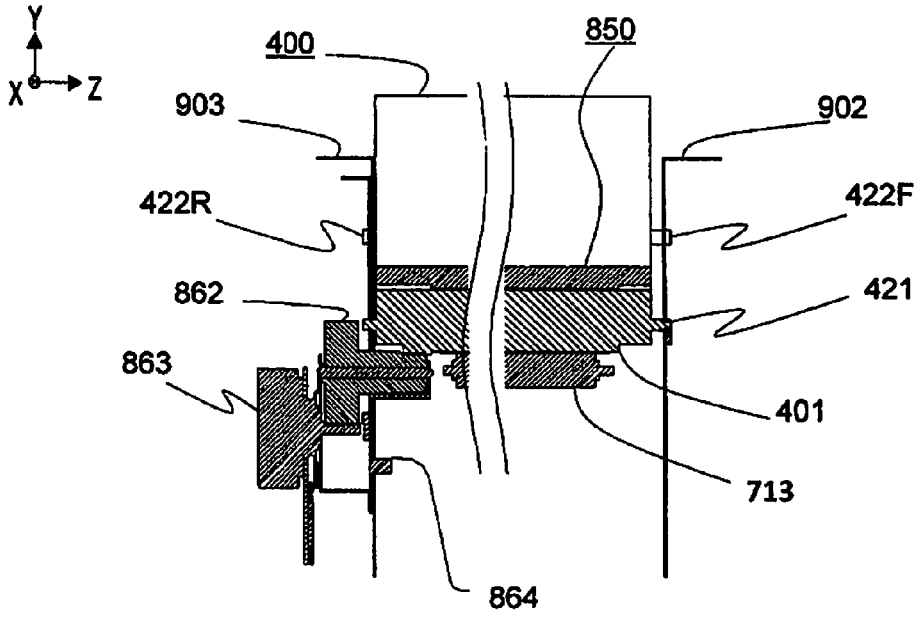
FIG. 35 is a side cross-sectional view illustrating the image formation section and the like of FIG. 33.
Figure 36:
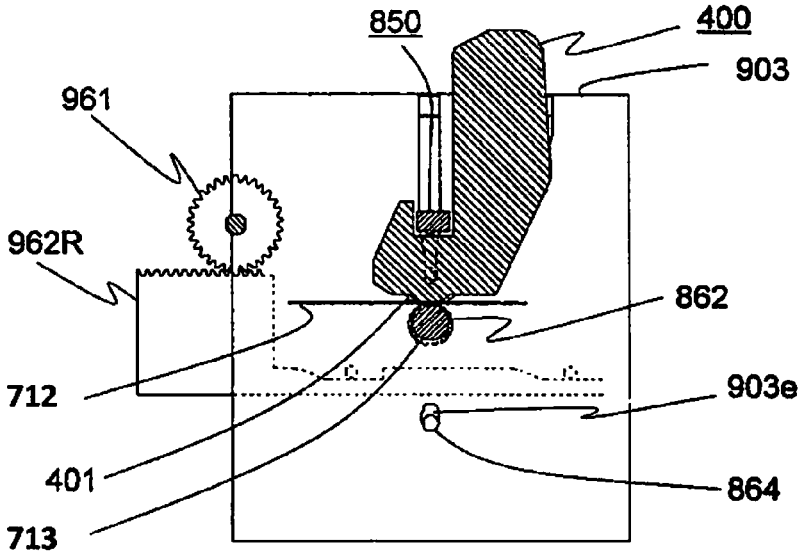
FIG. 36 is a front cross-sectional view illustrating the image formation section and the like of FIG. 35.

FIGS. 27 and 28 are explanatory views of motor unit 860 which drives image formation section 450. FIG. 27 is a perspective view of motor unit 860 seen from the inner side, and FIG. 28 is a perspective view of motor unit 860 seen from the outer side.

Motor unit 860 functions as a holder. Motor unit 860 is configured to include drum drive gear 862 which meshes with drum gear 420 provided on photoconductive drum 401 to drive photoconductive drum 401, drive motor 863 which drives drum drive gear 862, and motor plate 861 to which drum drive gear 862 and drive motor 863 are attached. The following are formed on motor plate 861: groove 861*a* with which drum shaft 421 formed in image formation section 450 is engaged, groove 861*b* with which pin 422R is engaged, guide pin 864 which engages with long hole 903*e* on rear plate 903, and guide pin 865 which abuts on slider 962, which is described later. Motor unit 860 is mounted to rear plate 903 of the apparatus main body.

FIGS. 29 to 32 are views explaining an aspect where image formation section 450 is mounted to the apparatus main body.

Image formation section 450 is movably supported in the upper and lower direction (Y-axis direction) such that drum shaft 421 and pins 422F and 422R are respectively fitted into groove 902*e*, 902*f*, 903*b*, and 903*c* of front plate 902 and rear plate 903. Motor unit 860 as a holder is attached to rear plate 903, and is connected to photoconductive drum 401. Motor unit 860 is attached to rear plate 903 to be slidable in the upper and lower directions. Motor unit 860 includes guide pin 865 which is placed on slider 962R. Accordingly, motor unit 860 moves upwardly or downwardly together with image formation section 450 with slider 962R.

The apparatus main body includes, similar to the configuration of the first embodiment, slider gear 961, and sliders 962F and 962R. Slider 962F is disposed on the side face of image formation section 450 and below drum shaft 421 with front plate 902 sandwiched therebetween. Slider 962R is disposed on the side face of image formation section 450 and below guide pin 865 formed on motor plate 861 with rear plate 903 and motor plate 861 sandwiched therebetween. Sliders 962F and 962R are moved in the X-axis direction by slider gear 961.

[Operation]

Next, an operation of the image formation apparatus with the above mentioned configuration is described on the basis of FIGS. 33 to 38. The overall operation of the image formation apparatus according to the embodiment is approximately similar to that of the image formation apparatus in the first embodiment. Therefore, only an operation specific to the image formation apparatus according to the embodiment is described below.

Figure 37:
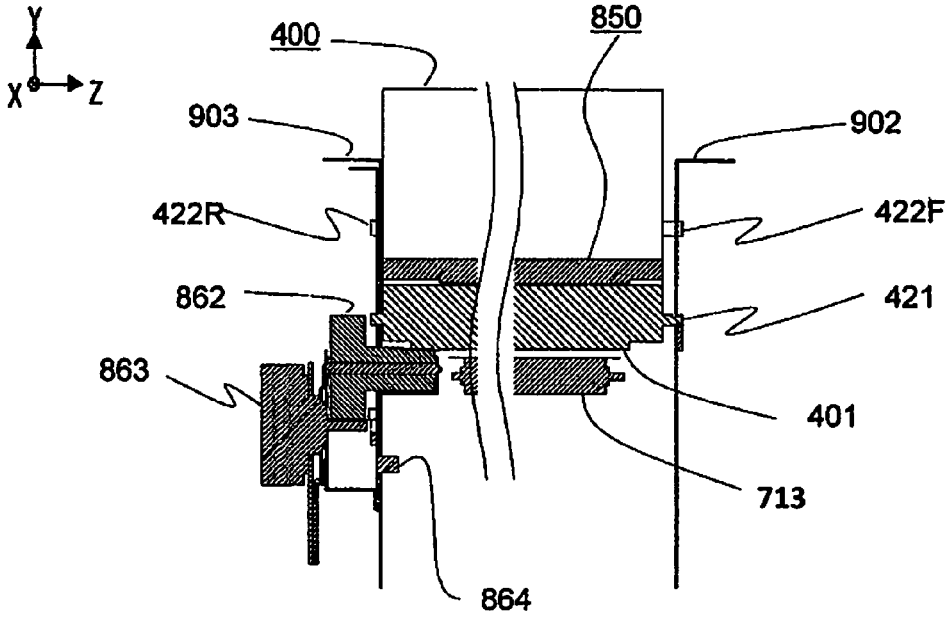
FIG. 37 is a side cross-sectional view illustrating the image formation section and the like of FIG. 34.
Figure 38:
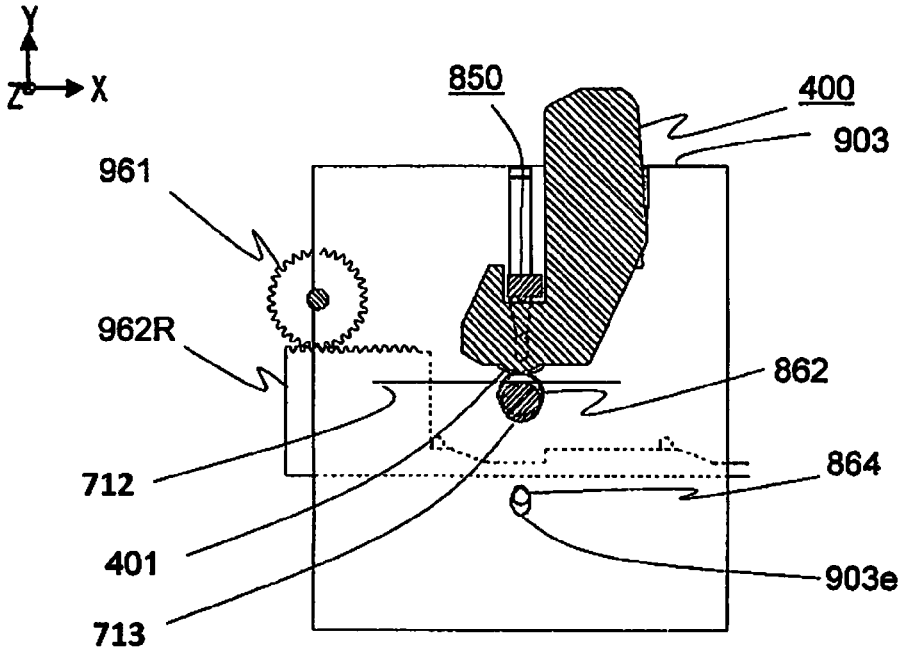
FIG. 38 is a front cross-sectional view illustrating the image formation section and the like of FIG. 37.

When slider gear 961 is driven to move sliders 962, slider 962F moves drum shaft 421 of image formation section 450 upward, and slider 962R moves guide pin 865 of upward. Because motor unit 860 and image formation section 450 are prevented from moving in the minus Y-axis direction by groove 861*a*, image formation section 450 moves upward (plus Y-axis direction), and separates from transfer rollers 713 of direct transfer belt unit 750 as illustrated in FIGS. 37 and 38.

[Effect]

With the image formation apparatus of the above mentioned configuration, when image formation section 450 moves between the image formation position and the non-image formation position, the connection is maintained between image formation section 450 and the gear of the drive unit (drive motor 863). Therefore, when the monochrome printing mode is switched to the color printing mode, for example, no color shift or no phase shift occurs among the respective colors due to the backlash of the connection unit, and no adjustment process for again adjusting the phase shift is required. Accordingly, the printing position accuracy is kept with no lowered performance, and a high printing quality is kept. Therefore, the reliability with respect to the image formation apparatus can be improved.

Moreover, when the gears are repeatedly meshed with and released from each other, the gears are required to have a sufficient strength because the collisions between teeth of the gears is repeated. In that case, it can be considered that a general resin gear is formed to have larger teeth as a large module, however, the gears are not meshed with each other smoothly to vibrate the photoconductive drum, which results in a lowered printing quality. Moreover, a gear may be made of a metal material to improve the strength thereof. However, metals are more expensive than resins, and have less effect of attenuating vibration, unlike a vibratory-reduction effect that resins possess. Therefore, the photoconductive drum is further vibrated, which results in the lowered printing quality.

In view of this problem, in the embodiment, the image formation section moves between the image formation position and the non-image formation position while the gears are being meshed with each other without being released. Therefore, a resin gear as a small module can be employed, and the high image quality can be obtained at a lower cost.

[Modification]

In the embodiments of the invention, the image formation apparatus in which four image formation units are used, and the intermediate transfer belt that transfers a toner image onto a printing medium, and the image formation apparatus in which image formation units directly transfer toner images onto a printing medium are described as examples to which the invention is applied. However, the invention is not limited to the examples, and is also applicable to a monochromatic image formation apparatus which uses only one image formation unit, a copying machine, a Multifunction Peripheral, or the like.

Moreover, although, in the respective embodiments, two aspects of the monochrome printing mode and the color printing mode are explained, four image formation units 400K, 400Y, 400M, and 400C may be operated in another aspect of individually moving four image formation units 400K, 400Y, 400M, and 400C up and down. Also in this case, the function and the effect similar to the respective embodiments can be exhibited.

Moreover, the invention is not limited to the abovementioned embodiments and the modification. When embodying the invention, the various components can be modified without departing from the spirit of the invention. Various inventions can be formed By combining a plurality of components disclosed in the embodiments and the modification described above.

Although intermediate transfer belt 701 is explained as the example of a transfer medium in the first embodiment, the invention is applicable to a general belt member as a transfer medium.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising:

an image formation unit including an image carrier configured to carry a developer image;

a drive unit configured to drive the image carrier;

a holder provided with the drive unit and configured to move together with the image formation unit;

a transfer unit located opposed to the image carrier and configured to transfer the developer image from the image carrier onto a transfer medium; and a switching unit configured to switch a position of the holder, between an image formation position, at which the transfer unit is operational to transfer the developer image from the image carrier onto the transfer medium, and a non-image formation position.

2. The image formation apparatus according to claim 1, wherein the holder is configured to move together with the image formation unit in a state where the holder holds the image formation unit and maintains a connection between the image carrier and the drive unit.

3. The image formation apparatus according to claim 1, wherein the switching unit is configured to move the holder together with the image formation unit.

4. The image formation apparatus according to claim 1, wherein the holder includes a first support unit configured to engage with an apparatus main body and support the holder and the image formation unit, and the switching unit includes:

a slider configured to engage with the first support unit and move the holder and the image formation unit to the image formation position or the non-image formation position; and a slider drive unit configured to drive the slider.

5. The image formation apparatus according to claim 4, wherein the transfer medium is an intermediate transfer belt, the apparatus main body includes a first engagement hole configured to engage with the first support unit or a second support unit, and the first engagement hole extends in a direction in which the image carrier is brought into contact with and is separated from the intermediate transfer belt.

6. The image formation apparatus according to claim 1, wherein the image formation unit includes a second support unit configured to engage with the apparatus main body and support the holder and the image formation unit, the switching unit includes:

a slider configured to engage with the second support unit and to move the holder and the image formation unit to the image formation position or the non-image formation position; and a slider drive unit configured to drive the slider.

7. The image formation apparatus according to claim 6, wherein the transfer medium is an intermediate transfer belt, the apparatus main body includes a second engagement hole configured to engage with one of the first support unit and the second support unit, and the second engagement hole extends in a direction in which the image carrier is brought into contact with and separated from the intermediate transfer belt.

8. The image formation apparatus according to claim 1, wherein the transfer medium is a belt member.

9. The image formation apparatus according to claim 1, wherein the transfer medium is a printing paper sheet.

10. The image formation apparatus according to claim 1, wherein the image formation unit is configured to slide to and removably mount to the holder.

11. The image formation apparatus according to claim 1, wherein the image formation unit is movable in a direction to be brought into contact with and separate from the transfer medium.

12. The image formation apparatus according to claim 1, wherein the image carrier and the drive unit are connected by a joint unit capable of being connected or released along an axis direction.

13. The image formation apparatus according to claim 1, wherein the image carrier comprises a gear wheel configured to mesh with a drive gear on the drive unit for rotatably driving the image carrier.

14. The image formation apparatus according to claim 1, wherein the transfer unit includes the transfer medium.

15. The image formation apparatus according to claim 14, wherein the transfer unit is an intermediate transfer belt unit configured to transfer the developer image from the image carrier onto the transfer medium.

16. The image formation apparatus according to claim 1, wherein the transfer medium comprises a recording medium.

17. The image formation apparatus according to claim 16, wherein the transfer unit is a direct transfer unit configured to directly transfer the developer image from the image carrier onto the recording medium as the transfer medium.

18. The image formation apparatus according to claim 15, wherein the intermediate transfer belt unit includes:

an intermediate transfer belt as the transfer medium;

a drive roller configured to drive the intermediate transfer belt;

a primary transfer roller facing the image carrier with intermediate transfer belt between the primary transfer roller and the image carrier at a primary transfer position and configured to transfer the developer image from the image carrier to the intermediate transfer belt; and a secondary transfer backup roller facing a secondary transfer roller with the intermediate transfer belt between the secondary transfer backup roller and the secondary transfer roller at a secondary transfer position, wherein the secondary transfer roller is configured to transfer the developer image from the intermediate transfer belt to a recording medium at the secondary transfer position.

19. The image formation apparatus according to claim 17, wherein the direct transfer unit includes:

a conveyance belt;

a drive roller configured to drive the conveyance belt; and a transfer roller facing the image carrier with intermediate transfer belt between the transfer roller and the image carrier and configured to transfer the developer image from the image carrier to the recording medium being conveyed on the conveyance belt.

* * * * *